US012109463B2

(12) United States Patent
Demkowski et al.

(10) Patent No.: US 12,109,463 B2
(45) **Date of Patent: *Oct. 8, 2024**

(54) GOLF CLUB HEAD

(71) Applicant: Taylor Made Golf Company, Inc, Carlsbad, CA (US)

(72) Inventors: Paul Demkowski, Cardiff, CA (US); Matt Bovee, Carlsbad, CA (US); Mike Walker, Vista, CA (US); Boo Ohashi, Vista, CA (US); Connor Halberg, San Clemente, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 110 days.

This patent is subject to a terminal disclaimer.

(21) Appl. No.: 18/087,580

(22) Filed: Dec. 22, 2022

(65) Prior Publication Data

US 2023/0201674 A1 Jun. 29, 2023

Related U.S. Application Data

(63) Continuation of application No. 17/087,596, filed on Nov. 2, 2020, now Pat. No. 11,559,727, which is a (Continued)

(51) Int. Cl.
*A63B 53/04* (2015.01)
*A63B 60/54* (2015.01)

(52) U.S. Cl.
CPC ..... *A63B 53/047* (2013.01); *A63B 53/0412* (2020.08); *A63B 53/0433* (2020.08); (Continued)

(58) Field of Classification Search
CPC ... A63B 53/047; A63B 53/0475; A63B 60/54; A63B 53/0462; A63B 53/0412; A63B 53/0433; A63B 53/0466
(Continued)

(56) References Cited

U.S. PATENT DOCUMENTS 2,034,936 A 3/1936 Barnhart
3,660,216 A 5/1972 Theodorson
(Continued)

FOREIGN PATENT DOCUMENTS

CA 2608831 6/2008
GB 1209466 10/1970
(Continued)

OTHER PUBLICATIONS

United States Golf Associate and R&A Rules Limited, Interim Procedure for Measuring the Coefficient of Restitution of an Iron Clubhead Relative to a Baseline Plate; Revision 1.2, Nov. 30, 2005, pp. 1-6.

(Continued)

*Primary Examiner* — Sebastiano Passaniti
(74) *Attorney, Agent, or Firm* — Kunzler Bean & Adamson

(57) ABSTRACT

Disclosed herein is an iron-type golf club head that comprises a body, made of a first material having a first density. The iron-type golf club head also comprises a weight located within the internal cavity. The iron-type golf club head further comprises a filler material that has a density no less than 0.21 g/cc. The filler material has a mass no less than 2.5 grams and no more than 8 grams. The internal cavity has an internal cavity volume ranging between 5 cc to 20 cc. A ratio of the internal cavity volume to external club head volume ranges between 0.14 and 0.385. The internal cavity has a minimum front-to-back depth above a midplane of the golf club head of no less than 1.4 mm and a maximum front-to-back depth of the internal cavity above the midplane of the golf club head is no more than 13 mm.

88 Claims, 9 Drawing Sheets

Related U.S. Application Data continuation-in-part of application No. 16/800,811, filed on Feb. 25, 2020, now Pat. No. 10,953,293, which is a continuation of application No. 15/706,632, filed on Sep. 15, 2017, now Pat. No. 10,625,126, which is a continuation-in-part of application No. 15/394,549, filed on Dec. 29, 2016, now Pat. No. 10,543,409.

(60) Provisional application No. 62/929,083, filed on Oct. 31, 2019.

(52) U.S. Cl.
CPC ..... *A63B 53/0462* (2020.08); *A63B 53/0466* (2013.01); *A63B 53/0475* (2013.01); *A63B 60/54* (2015.10)

(58) Field of Classification Search
USPC ..... 473/324–350, 287–292
See application file for complete search history.

(56) References Cited

U.S. PATENT DOCUMENTS 4,180,269 A 12/1979 Thompson
4,398,965 A 8/1983 Campau
4,728,105 A 3/1988 Kobayashi
5,178,392 A 1/1993 Santioni
5,184,823 A 2/1993 Desboilles et al.
5,255,918 A 10/1993 Anderson
5,290,036 A 3/1994 Fenton et al.
5,301,946 A 4/1994 Schmidt et al.
5,362,047 A 11/1994 Shaw et al.
5,423,535 A 6/1995 Shaw et al.
5,447,311 A 9/1995 Viollaz et al.
5,472,203 A 12/1995 Schmidt et al.
5,544,885 A 8/1996 Besnard et al.
5,547,427 A 8/1996 Rigal et al.
5,595,548 A * 1/1997 Beck ..... B22D 25/02 473/324
5,616,086 A 4/1997 Chappell
5,688,188 A 11/1997 Chappell
5,766,092 A 6/1998 Mimeur et al.
5,792,005 A 8/1998 Sieleman et al.
5,795,240 A 8/1998 Chappell
5,807,189 A 9/1998 Martin et al.
5,833,551 A 11/1998 Vincent et al.
5,913,735 A 6/1999 Kenme
6,045,456 A 4/2000 Best et al.
6,086,485 A 7/2000 Hamada et al.
6,117,023 A 9/2000 Onuki et al.
6,146,571 A 11/2000 Vincent et al.
6,149,534 A 11/2000 Peters et al.
6,159,109 A 12/2000 Langslet
6,309,309 B1 10/2001 Beach et al.
6,346,052 B1 2/2002 Chappell
6,533,679 B1 3/2003 McCabe et al.
6,616,547 B2 9/2003 Vincent et al.
6,638,183 B2 10/2003 Takeda
6,688,989 B2 2/2004 Best
6,719,642 B2 4/2004 Wahl et al.
6,800,038 B2 10/2004 Willett et al.
6,811,496 B2 11/2004 Wahl et al.
6,830,519 B2 12/2004 Reed et al.
6,875,124 B2 4/2005 Gilbert et al.
6,904,663 B2 6/2005 Willett et al.
6,930,150 B2 8/2005 Kim
6,991,559 B2 1/2006 Yabu
7,077,763 B2 7/2006 Wahl et al.
7,083,530 B2 8/2006 Wahl et al.
7,121,958 B2 10/2006 Cheng et al.
7,153,219 B2 12/2006 Reed et al.
7,169,057 B2 1/2007 Wood et al.
7,182,698 B2 2/2007 Tseng
7,226,366 B2 6/2007 Galloway
7,273,418 B2 9/2007 Gilbert et al.
7,281,989 B2 10/2007 Hou
7,281,991 B2 10/2007 Gilbert et al.
7,303,485 B2 12/2007 Tseng
7,303,486 B2 12/2007 Imamoto
7,371,188 B2 5/2008 Chen
7,445,561 B2 11/2008 Newman et al.
7,476,162 B2 1/2009 Stites et al.
7,491,134 B2 2/2009 Murphy et al.
7,491,136 B2 2/2009 Deng et al.
7,559,850 B2 7/2009 Gilbert
7,575,524 B2 8/2009 Willett et al.
7,582,024 B2 9/2009 Shear
7,591,735 B2 9/2009 Matsunaga et al.
7,662,051 B2 2/2010 Chen
7,871,338 B2 1/2011 Nakano et al.
7,922,604 B2 4/2011 Roach
8,012,040 B2 9/2011 Takechi
8,033,931 B2 10/2011 Wahl et al.
8,088,025 B2 1/2012 Wahl et al.
8,157,668 B2 4/2012 Wahl et al.
8,206,241 B2 6/2012 Boyd et al.
8,210,965 B2 7/2012 Roach et al.
8,328,663 B2 12/2012 Wahl et al.
8,353,785 B2 1/2013 Ines et al.
8,353,786 B2 1/2013 Beach et al.
8,409,028 B2 4/2013 Wahl et al.
8,475,293 B2 7/2013 Morin et al.
8,485,918 B2 7/2013 Roach et al.
8,512,164 B2 8/2013 Ines et al.
8,517,863 B2 8/2013 Wahl et al.
8,535,176 B2 9/2013 Bazzel et al.
8,535,177 B1 9/2013 Wahl et al.
8,608,592 B2 12/2013 Deng et al.
8,708,837 B2 4/2014 Roach et al.
8,727,909 B2 5/2014 Guerrette et al.
8,740,719 B2 6/2014 Wahl et al.
8,777,776 B2 7/2014 Wahl et al.
8,814,725 B2 8/2014 Wahl et al.
8,821,313 B1 9/2014 Dawson et al.
8,858,364 B2 10/2014 Deng et al.
8,911,301 B1 12/2014 Allen
8,920,261 B2 12/2014 Taylor et al.
8,926,448 B1 1/2015 Ivanova et al.
8,932,150 B2 1/2015 Ines et al.
8,956,242 B2 2/2015 Rice et al.
8,974,317 B1 3/2015 Griffin et al.
9,033,817 B2 5/2015 Snyder
9,044,653 B2 6/2015 Wahl et al.
9,138,621 B2 9/2015 Roach et al.
9,138,622 B1 9/2015 DeMille et al.
9,155,945 B2 10/2015 Demkowski et al.
9,192,830 B2 11/2015 Parsons et al.
9,199,138 B2 12/2015 Willett et al.
9,199,143 B1 12/2015 Parsons et al.
9,211,451 B1 12/2015 Westrum et al.
9,265,995 B2 2/2016 Wahl et al.
9,440,121 B2 9/2016 Deng et al.
9,468,819 B2 10/2016 Rice et al.
9,468,821 B2 10/2016 Parsons et al.
9,492,722 B2 11/2016 Taylor et al.
9,764,208 B1 2/2017 Parsons et al.
9,586,105 B1 3/2017 Westrum et al.
9,597,562 B2 3/2017 Dipert et al.
9,610,483 B2 4/2017 Burnett et al.
9,623,298 B2 4/2017 Ban
9,623,299 B2 4/2017 Wahl et al.
9,662,548 B2 5/2017 Guerrette et al.
9,675,850 B2 6/2017 Bennett et al.
9,731,176 B2 8/2017 Issertell et al.
9,802,089 B2 10/2017 Honea et al.
9,802,091 B2 10/2017 Taylor et al.
9,808,685 B1 11/2017 Westrum et al.
9,849,348 B2 12/2017 Beach et al.
9,849,357 B2 12/2017 Wahl et al.
9,937,395 B2 4/2018 Taylor et al.
9,950,397 B2 4/2018 Taylor et al.
9,975,018 B2 5/2018 Dipert et al.

(56) References Cited

U.S. PATENT DOCUMENTS 10,004,957 B2 6/2018 Franz et al.
10,039,965 B1 8/2018 Seluga et al.
10,065,090 B2 9/2018 Guerrette et al.
10,099,092 B2 10/2018 Morin et al.
10,112,084 B2 10/2018 Stokke et al.
10,155,143 B2 12/2018 Wahl et al.
10,173,109 B1 1/2019 Seluga et al.
10,245,484 B2 4/2019 Dipert et al.
10,258,843 B2 4/2019 Morales et al.
10,293,223 B2 5/2019 Kii
10,343,035 B2 7/2019 Chen
10,398,950 B2 9/2019 Honea et al.
10,406,410 B2 9/2019 Wahl et al.
10,423,945 B2 9/2019 Long et al.
RE47,653 E 10/2019 Wahl et al.
10,427,014 B2 10/2019 Taylor et al.
10,493,335 B2 12/2019 Issertell et al.
10,493,336 B2 12/2019 Taylor et al.
10,518,143 B1 12/2019 Greaney et al.
10,543,409 B2 1/2020 Demkowski et al.
10,596,425 B2 3/2020 Parsons et al.
10,610,749 B2 4/2020 Wahl et al.
10,625,124 B2 4/2020 Morin et al.
10,625,126 B2 4/2020 Demkowski et al.
10,625,127 B2 4/2020 Golden et al.
10,646,757 B2 5/2020 Dipert et al.
10,792,543 B2 10/2020 Taylor et al.
10,799,778 B2 10/2020 Guerrette et al.
10,843,046 B2 11/2020 Bennett et al.
10,843,050 B2 11/2020 Albertsen et al.
10,870,042 B2 12/2020 Wahl et al.
10,874,919 B2 * 12/2020 Parsons ..... A63B 53/04
10,874,920 B2 12/2020 Issertell et al.
10,881,925 B2 1/2021 Demkowski et al.
10,881,926 B1 1/2021 Hill et al.
10,888,749 B2 1/2021 Honea et al.
10,953,293 B2 3/2021 Demkowski et al.
10,960,277 B2 3/2021 Greaney et al.
11,004,046 B2 5/2021 Long et al.
11,020,639 B2 6/2021 Golden et al.
11,045,696 B2 6/2021 Burnett et al.
11,045,697 B2 6/2021 Seluga et al.
11,090,532 B2 8/2021 Wahl et al.
11,141,632 B2 10/2021 Taylor et al.
11,164,171 B2 11/2021 Long et al.
11,167,341 B2 11/2021 Yu et al.
11,185,746 B2 11/2021 Issertell et al.
11,185,747 B2 * 11/2021 Wang ..... A63B 60/02
11,202,946 B2 12/2021 Golden et al.
11,338,183 B2 5/2022 Taylor et al.
11,351,425 B2 6/2022 Albertsen et al.
11,351,426 B2 6/2022 Demkowski et al.
11,351,429 B2 6/2022 Halberg et al.
11,400,351 B2 8/2022 Halberg et al.
11,406,882 B2 8/2022 Taylor et al.
11,413,510 B2 8/2022 Halberg et al.
11,420,097 B2 8/2022 Demkowski et al.
11,420,098 B2 8/2022 Honea et al.
11,458,374 B2 10/2022 Halberg et al.
11,478,685 B2 10/2022 Burnett et al.
11,497,972 B2 11/2022 Hill et al.
11,504,588 B2 11/2022 Barker et al.
RE49,326 E 12/2022 Wahl et al.
11,559,727 B2 * 1/2023 Demkowski ..... A63B 60/02
11,577,307 B2 2/2023 Yu et al.
11,745,065 B2 9/2023 Dipert et al.
11,771,964 B2 10/2023 Albertsen et al.
11,771,965 B2 10/2023 Issertell et al.
11,801,427 B2 10/2023 Taylor et al.
11,878,340 B2 1/2024 Yu et al.
11,883,724 B2 1/2024 Halberg et al.
11,890,516 B2 2/2024 Taylor et al.
11,992,735 B1 5/2024 Demkowski et al.
2001/0055996 A1 12/2001 Iwata
2002/0165041 A1 11/2002 Takeda et al.
2004/0043830 A1 3/2004 Imamoto
2004/0266548 A1 12/2004 Cheng et al.
2005/0009633 A1 1/2005 Rice et al.
2005/0009634 A1 1/2005 Rice et al.
2005/0119070 A1 6/2005 Kumamoto
2005/0124437 A1 6/2005 Imamoto
2005/0143188 A1 6/2005 Tseng
2005/0187034 A1 8/2005 Rice et al.
2005/0192116 A1 9/2005 Imamoto
2006/0068932 A1 3/2006 Rice et al.
2006/0128501 A1 6/2006 Rice
2006/0252575 A1 11/2006 Chen
2007/0129162 A1 6/2007 Pan et al.
2007/0129166 A1 6/2007 Shimazaki et al.
2008/0022502 A1 * 1/2008 Tseng ..... A63B 53/047
473/332
2008/0076597 A1 3/2008 Roach et al.
2009/0062032 A1 3/2009 Boyd et al.
2009/0137339 A1 5/2009 Nakano
2010/0035017 A1 2/2010 Green
2010/0056298 A1 3/2010 Jertson et al.
2010/0197425 A1 8/2010 Clausen et al.
2011/0028240 A1 2/2011 Wahl et al.
2011/0151997 A1 6/2011 Shear
2011/0159984 A1 6/2011 Shimazaki
2011/0230279 A1 9/2011 Oldknow et al.
2011/0275451 A1 11/2011 Chao et al.
2012/0122606 A1 * 5/2012 Yamamoto ..... A63B 60/02
473/332
2012/0196702 A1 8/2012 Shimazaki
2013/0125366 A1 5/2013 Ines et al.
2013/0150177 A1 6/2013 Takechi
2013/0178306 A1 7/2013 Beno et al.
2013/0252751 A1 9/2013 Bittner
2013/0252754 A1 9/2013 Bazzel et al.
2013/0281227 A1 10/2013 Roach et al.
2013/0318772 A1 * 12/2013 Wahl ..... A63B 60/00
29/530
2013/0331201 A1 12/2013 Wahl et al.
2014/0248977 A1 9/2014 Morin et al.
2014/0274442 A1 9/2014 Honea et al.
2014/0274456 A1 9/2014 Cardani et al.
2015/0133232 A1 5/2015 Taylor et al.
2015/0190687 A1 7/2015 Clausen
2015/0231806 A1 * 8/2015 Parsons ..... A63B 53/0475
264/261
2015/0328504 A1 11/2015 Finn et al.
2015/0375065 A1 12/2015 Beach et al.
2016/0038796 A1 2/2016 Taylor et al.
2016/0144248 A1 5/2016 Chen
2016/0193508 A1 7/2016 Issertell et al.
2016/0287952 A1 10/2016 James et al.
2017/0028271 A1 2/2017 Petersen
2018/0028883 A1 2/2018 Morin et al.
2018/0050245 A1 * 2/2018 Parsons ..... A63B 53/0475
2018/0104552 A1 4/2018 Hebreo et al.
2018/0185715 A1 7/2018 Demkowski et al.
2018/0185717 A1 7/2018 Demkowski et al.
2018/0189758 A1 7/2018 Beach et al.
2018/0221725 A1 8/2018 Westrum et al.
2018/0236324 A1 8/2018 Hebreo et al.
2018/0339207 A1 11/2018 Hebreo et al.
2019/0282870 A1 9/2019 Hebreo et al.
2019/0374822 A1 12/2019 Barker et al.
2020/0171362 A1 6/2020 Wang et al.
2020/0188740 A1 6/2020 Demkowski et al.
2020/0197761 A1 6/2020 Demkowski et al.
2020/0282277 A1 * 9/2020 Spackman ..... A63B 53/0475
2020/0298077 A1 9/2020 Clarke et al.
2020/0338399 A1 * 10/2020 Takahashi ..... A63B 53/047
2020/0353320 A1 * 11/2020 Bacon ..... A63B 53/0466
2021/0046360 A1 2/2021 Demkowski et al.
2021/0146206 A1 5/2021 Hill et al.
2021/0162275 A1 6/2021 Demkowski et al.
2021/0236887 A1 8/2021 Demkowski et al.
2022/0233924 A1 7/2022 Woodward

(56) References Cited

U.S. PATENT DOCUMENTS

| | | | |
|---|---|---|---|
| 2023/0113663 | A1 | 4/2023 | Hill et al. |
| 2024/0181307 | A1 | 6/2024 | Demkowski et al. |

FOREIGN PATENT DOCUMENTS

| | | |
|---|---|---|
| JP | H05-091732 | 12/1993 |
| JP | 7-213656 | 8/1995 |
| JP | H08308967 | 11/1996 |
| JP | 2003260153 | 9/2003 |
| JP | 2004008565 | 1/2004 |
| JP | 2004313777 | 11/2004 |
| JP | 2005013711 | 1/2005 |
| JP | 2006110348 | 4/2006 |
| JP | 2008036006 | 2/2008 |
| JP | 2008080095 | 4/2008 |
| JP | 2008272241 | 11/2008 |
| JP | 4291836 | 7/2009 |
| JP | 2009232968 | 10/2009 |
| JP | 2011024999 | 2/2011 |
| JP | 2012105821 | 6/2012 |
| JP | 2015128580 | 7/2015 |
| JP | 2018110844 | 7/2018 |
| JP | 2018126489 | 8/2018 |
| JP | 2002143356 | 5/2022 |
| WO | 0183049 | 11/2001 |
| WO | 2011115749 | 9/2011 |

OTHER PUBLICATIONS

Japanese Office Action for Japanese Patent Application No. 2017-234079 dated Sep. 8, 2021.

Japanese Office Action for JP Patent Application Publication No. 2022-000078 dated Oct. 25, 2022.

Translation of JP-3146396, titled "Golf Club head with shock absorber", published Nov. 13, 2008, inventor name not available. (Year: 2008).

* cited by examiner

GOLF CLUB HEAD

CROSS-REFERENCE TO RELATED APPLICATIONS

This application is a continuation of U.S. patent application Ser. No. 17/087,596, which claims the benefit of U.S. Provisional Patent Application No. 62/929,083, filed Oct. 21, 2019, and is a continuation-in-part of U.S. patent application Ser. No. 16/800,811, filed Feb. 25, 2020, which is a continuation of U.S. Pat. No. 10,625,126, filed Sep. 15, 2017, which is a continuation-in-part of U.S. Pat. No. 10,543,409, filed Dec. 29, 2016. This application also references U.S. patent application Ser. No. 15/394,549, filed Dec. 29, 2016, and U.S. patent application Ser. No. 15/706,632, filed Sep. 15, 2017, which is a continuation-in-part of U.S. patent application Ser. No. 15/394,549, both of which are incorporated by reference herein in their entireties. This application also references U.S. Pat. No. 9,044,653, filed Mar. 14, 2013, which claims the benefit of U.S. Provisional Patent Application No. 61/657,675, filed Jun. 8, 2012, both of which are hereby incorporated by reference herein in their entireties. This application further references U.S. Pat. No. 8,353,785, filed Apr. 19, 2010, which claims the benefit of U.S. Provisional Patent Application No. 61/214,487, filed Apr. 23, 2009, both of which are hereby incorporated by reference herein in their entireties. This application also references U.S. Pat. No. 6,811,496, filed Sep. 3, 2002, which is hereby incorporated by reference in its entirety. This application additionally references U.S. patent application Ser. No. 13/111,715, filed May 19, 2011, which is incorporated herein by reference in its entirety. This application further references U.S. patent application Ser. No. 14/981,330, filed Dec. 28, 2015, which claims the benefit of U.S. Provisional Patent Application No. 62/099,012, filed Dec. 31, 2014, U.S. Provisional Patent Application No. 62/098,707, filed Dec. 31, 2014, and U.S. Provisional Patent Application No. 62/846,492, filed May 10, 2019,

FIELD

This disclosure relates generally to golf clubs, and more particularly to a golf club head with a strike plate that is separately attached to a body of the golf club head.

BACKGROUND

The performance of golf equipment is continuously advancing due to the development of innovative clubs and club designs. While all clubs in a golfer's bag are important, both scratch and novice golfers rely on the performance and feel of their irons for many commonly encountered playing situations.

Advancements in golf club head manufacturing techniques have facilitated the manufacturing of golf club heads with advanced geometries, configurations, and materials. Many performance considerations affect the design and material properties of a golf club head. However, in some instances, one performance characteristic may be sacrificed for another performance characteristic based on the design and or material selected for the golf club head. Making a golf club head that utilizes advances geometries, configurations, and materials without significantly negatively impacting performance characteristics can be difficult.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

Disclosed herein is an iron-type golf club head that comprises a body, made of a first material having a first density. The body comprises a heel portion, a toe portion, a sole portion, a top portion, a front portion, comprising a strike face, a rear portion, comprising a rear wall, and an internal cavity enclosed by the heel portion, the toe portion, the sole portion, the top portion, the front portion and the rear wall of the rear portion. The iron-type golf club head also comprises a weight, made of a second material having a second density greater than the first density. The weight is located within the internal cavity. The iron-type golf club head further comprises a filler material, located within the internal cavity and interposed between the weight and the front portion. The filler material has a density no less than 0.21 g/cc. The filler material has a mass no less than 2.5 grams and no more than 8 grams. The golf club head has an external club head volume ranging between 40 cc to 55 cc. The internal cavity has an internal cavity volume ranging between 5 cc to 20 cc. A ratio of the internal cavity volume to external club head volume ranges between 0.14 and 0.385. The internal cavity has a minimum H front-to-back depth above a midplane of the golf club head of no less than 1.4 mm and a maximum front-to-back depth of the internal cavity above the midplane of the golf club head is no more than 13 mm. The midplane is located halfway between a maximum toe height and a ground plane when the club head is a proper address position. No more than one external weight is located external to the interior cavity. An external weight is defined as anything coupled to the body having a mass more than 3 grams. The preceding subject matter of this paragraph characterizes example 1 of the present disclosure.

The body further comprises a weight channel, located within the internal cavity and open to the front portion. The weight is located within the weight channel. The weight channel and the weight are elongated and parallel to the strike face. The preceding subject matter of this paragraph characterizes example 2 of the present disclosure, wherein example 2 also includes the subject matter according to example 1, above.

The weight has a length, height, and depth. The length of the weight is at least eight times greater than each one of the height and the depth of the weight. The preceding subject matter of this paragraph characterizes example 3 of the present disclosure, wherein example 3 also includes the subject matter according to example 2, above.

The weight channel comprises a closed back side, a closed top side, a closed bottom side, and an open front side. The weight extends forwardly toward the front portion beyond the open front side of the weight channel weight extends forwardly toward the front portion beyond the open front side of the weight channel. The preceding subject matter of this paragraph characterizes example 4 of the present disclosure, wherein example 4 also includes the subject matter according to any one of examples 1-3, above.

The body further comprises a back-constraining wall that is formed in the sole portion and faces the front portion. The body also comprises an internal overhang, extending forwardly from the back-constraining wall. The internal overhang defines an internal shelf that is angled relative to the back-constraining wall. The body additionally comprises an upper-constraining wall that extends forwardly from the back-constraining wall and is vertically offset from the internal shelf. The body also comprises a side-constraining wall that extends forwardly from the back-constraining wall at a heelward side of the back-constraining wall and adjoins the internal shelf and the upper-constraining wall. The weight channel is defined by the back-constraining wall, the internal shelf, the upper-constraining wall, and the side-constraining wall. The weight is made of a material having a density of at least 12 g/cc. The preceding subject matter of this paragraph characterizes example 5 of the present disclosure, wherein example 5 also includes the subject matter according to any one of examples 1-4, above.

The foam has a density greater than 0.35 g/cc. The preceding subject matter of this paragraph characterizes example 6 of the present disclosure, wherein example 6 also includes the subject matter according to any one of examples 1-5, above.

The front portion further comprises a face opening and a strike plate comprising a sole wrap portion coupled to and enclosing the face opening. A thickness of the strike plate defining the strike face is less than or equal to 2.85 mm and greater than or equal to 1.1 mm. The preceding subject matter of this paragraph characterizes example 7 of the present disclosure, wherein example 7 also includes the subject matter according to any one of examples 1-6, above.

The front portion further comprises a face opening and a strike plate comprising a top wrap portion coupled to and enclosing the face opening. A thickness of the strike plate defining the strike face is less than or equal to 2.85 mm and greater than or equal to 1.1 mm. The preceding subject matter of this paragraph characterizes example 8 of the present disclosure, wherein example 8 also includes the subject matter according to any one of examples 1-7, above.

The strike plate comprises an internal surface, opposite the strike face, and a weld guide protruding from the internal surface and extending along, and offset to, an outer peripheral edge of the strike plate. The preceding subject matter of this paragraph characterizes example 9 of the present disclosure, wherein example 9 also includes the subject matter according to example 8, above.

Further disclosed herein is an iron-type golf club head that comprises a body, made of a first material having a first density. The body comprises a heel portion, a toe portion, a sole portion, a top portion, a front portion, comprising a strike face, a rear portion, comprising a rear wall, and an internal cavity enclosed by the heel portion, the toe portion, the sole portion, the top portion, the front portion and the rear wall of the rear portion. The iron-type golf club head also comprises a weight that is made of a second material having a second density greater than the first density. The weight is located within the internal cavity. The iron-type golf club head further comprises a filler material, located within the internal cavity and interposed between the weight and the front portion. The filler material has a density no less than 0.21 g/cc. The filler material has a mass no less than 2.5 grams and no more than 8 grams. The golf club head has an external club head volume ranging between 40 cc to 55 cc. The internal cavity has an internal cavity volume ranging between 5 cc to 20 cc. A ratio of the internal cavity volume to external club head volume ranges between 0.204 and 0.385. The internal cavity has a minimum front-to-back depth above a midplane of the golf club head of no less than 1.4 mm, a first front-to-back depth proximate the midplane of the golf club head, a second front-to-back depth proximate a topline portion of the internal cavity of the golf club head, and a third front-to-back depth of the internal cavity located in between the midplane of the golf club and the topline portion of the internal cavity. The third front-to-back depth of the internal cavity is less than the first front-to-back depth and the second front-to-back depth. The third front-to-back depth of the internal cavity is less than 5 mm. The midplane is located halfway between a maximum toe height and a ground plane when the club head is in a proper address position. The preceding subject matter of this paragraph characterizes example 10 of the present disclosure.

Additionally disclosed herein is an iron-type golf club head that comprises a body, made of a first material having a first density. The body comprises a heel portion, a toe portion, a sole portion, a top portion, a front portion, comprising a strike face, a rear portion, comprising a rear wall, and an internal cavity enclosed by the heel portion, the toe portion, the sole portion, the top portion, the front portion and the rear wall of the rear portion. The iron-type golf club head also comprises a filler material that is located within the internal cavity and interposed between the weight and the front portion. A loft of the golf club head at proper address position is less than 35 degrees. A maximum thickness of the strike face is less than 3.1 mm. A minimum thickness of the strike face is less than 2.0 mm and no less than 1.0 mm. A density of the filler material is between 0.20 grams per cubic centimeter (g/cc) and 0.71 g/cc. An external volume of the golf club head is between 40 cc and 55 cc. The golf club head has a coefficient of restitution value greater than 0.79. A maximum front-to-back depth proximate the topline portion of the internal cavity of the golf club is no more than 6 mm. The preceding subject matter of this paragraph characterizes example 11 of the present disclosure.

The strike plate comprises a sole wrap portion that defines a part of the sole portion. The preceding subject matter of this paragraph characterizes example 12 of the present disclosure, wherein example 12 also includes the subject matter according to example 11, above.

The strike plate comprises a sole wrap portion that defines a part of the sole portion. The strike plate comprises a top wrap portion that defines a part of the top portion. The preceding subject matter of this paragraph characterizes example 13 of the present disclosure, wherein example 13 also includes the subject matter according to any one of examples 11-12, above.

The internal cavity has a sole portion, a central portion, and a topline portion, and a front-to-back depth of the internal cavity is maximum proximate the central portion. The preceding subject matter of this paragraph characterizes example 14 of the present disclosure, wherein example 14 also includes the subject matter according to any one of examples 11-13, above.

A maximum front-to-back depth proximate the topline portion of the internal cavity of the golf club is no more than 4.5 mm. The preceding subject matter of this paragraph characterizes example 15 of the present disclosure, wherein example 15 also includes the subject matter according to any one of examples 11-14, above.

The internal cavity has a minimum front-to-back depth above a midplane of the golf club head of no less than 1.0 mm, a first front-to-back depth proximate the midplane of the golf club head, a second front-to-back depth proximate a topline portion of the internal cavity of the golf club head, and a third front-to-back depth of the internal cavity located halfway in between the midplane of the golf club and the topline portion of the internal cavity, and the third front-to-back depth of the internal cavity may range between 55% to 195% of a maximum front-to-back internal cavity depth proximate the topline portion of the internal cavity. The preceding subject matter of this paragraph characterizes example 16 of the present disclosure, wherein example 16 also includes the subject matter according to any one of examples 11-15, above.

A ratio of the internal cavity volume to external club head volume ranges between 0.204 and 0.385. The preceding subject matter of this paragraph characterizes example 17 of the present disclosure, wherein example 17 also includes the subject matter according to example 16, above.

The filler material is a two-part polyurethane foam. The preceding subject matter of this paragraph characterizes example 18 of the present disclosure, wherein example 18 also includes the subject matter according to example 17, above.

The mass of the filler material is between 2 grams and 10 grams. The preceding subject matter of this paragraph characterizes example 19 of the present disclosure, wherein example 19 also includes the subject matter according to example 18, above.

The face material is a high strength steel having a tensile strength of no less than 570 MPa, and a maximum face thickness is no more than 2.85 mm and a minimum face thickness is no less than 1.1 mm. The preceding subject matter of this paragraph characterizes example 20 of the present disclosure, wherein example 20 also includes the subject matter according to any one of examples 18-19, above.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter and are not therefore to be considered to be limiting of its scope, the subject matter will be described and explained with additional specificity and detail through the use of the drawings, in which.

DETAILED DESCRIPTION

The following describes examples of golf club heads in the context of an iron-type golf club, but the principles, methods and designs described may be applicable in whole or in part to utility golf clubs (also known as hybrid golf clubs), metal-wood-type golf club, driver-type golf clubs, putter-type golf clubs, and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 3:
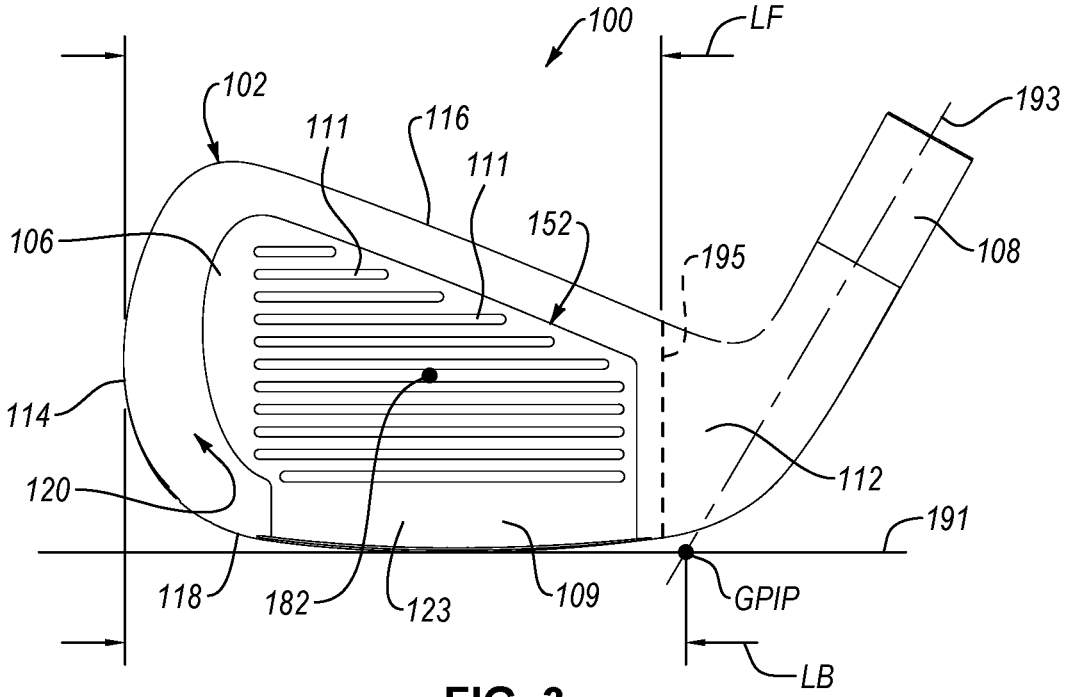
FIG. 3 is a front view of the golf club head of FIG. 1, according to one or more examples of the present disclosure.
Figure 4:
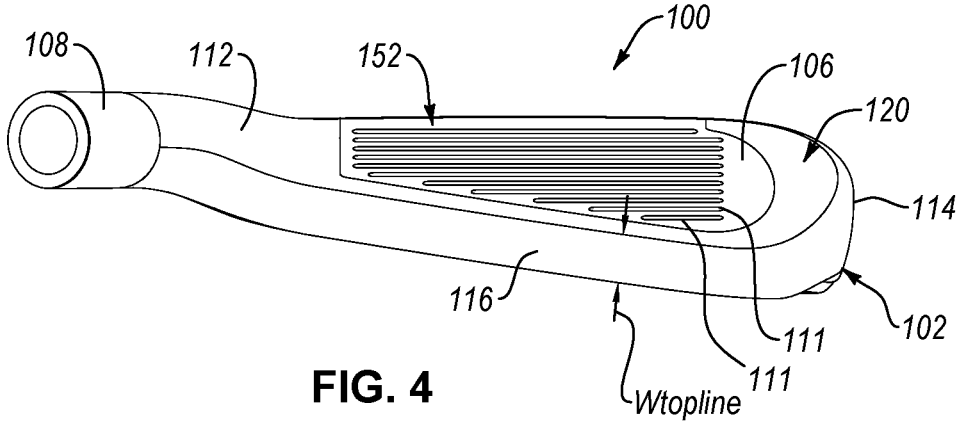
FIG. 4 is a top view of the golf club head of FIG. 1, according to one or more examples of the present disclosure.
Figure 10:
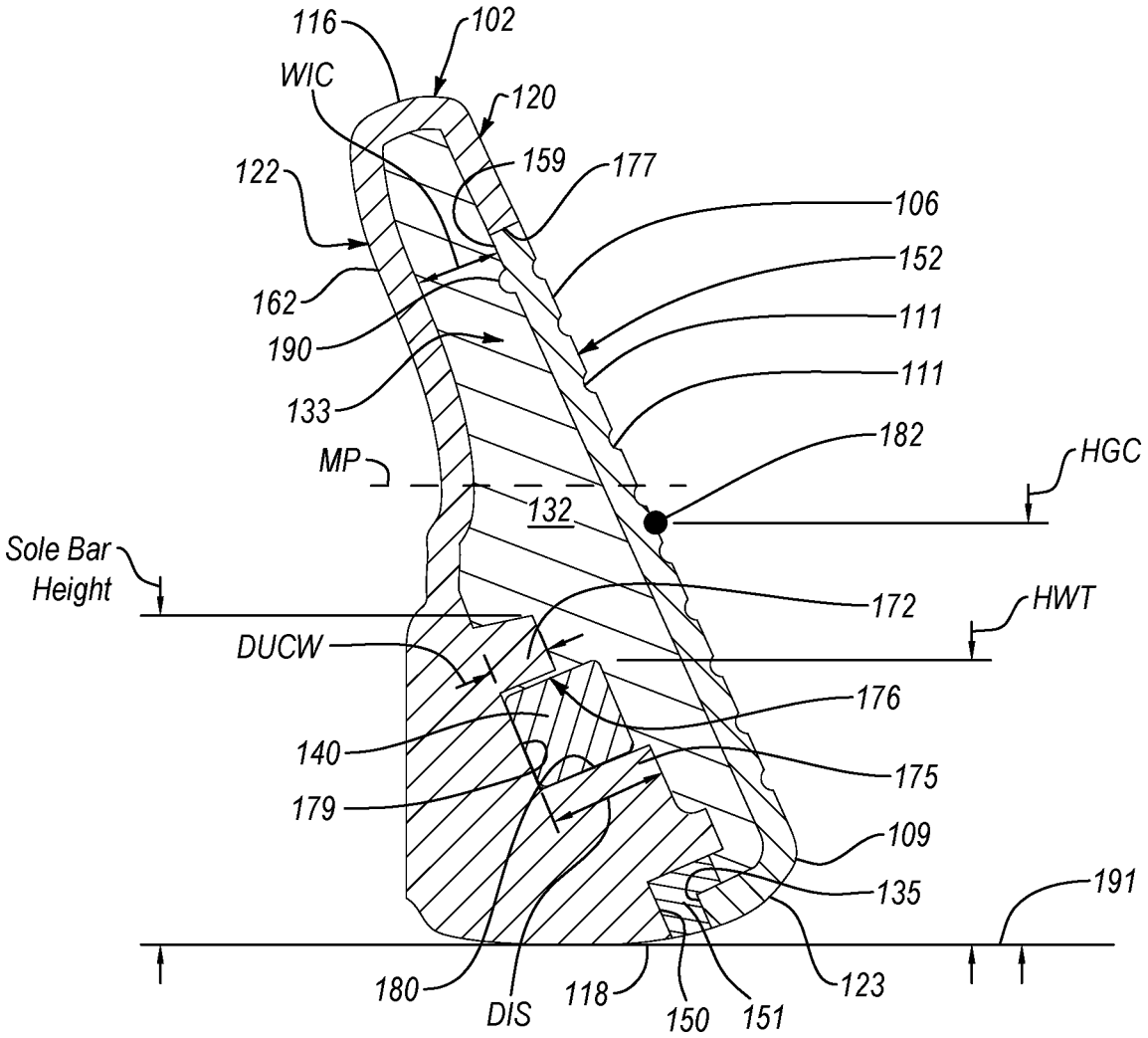
FIG. 10 is a cross-sectional side view of the golf club head of FIG. 1, taken along the line 8-8 of FIG. 2, according to one or more examples of the present disclosure.

FIGS. 3 and 10 are examples that show a golf club head in the address position (i.e. the club head is positioned such that a hosel axis, of the club head, is at a 60 degree lie angle relative to a ground plane and the club face is square relative to an imaginary target line). As shown in FIGS. 3 and 10, positioning a golf club head 100 in the reference position lends itself to using a club head origin coordinate system for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system.

Figure 1:
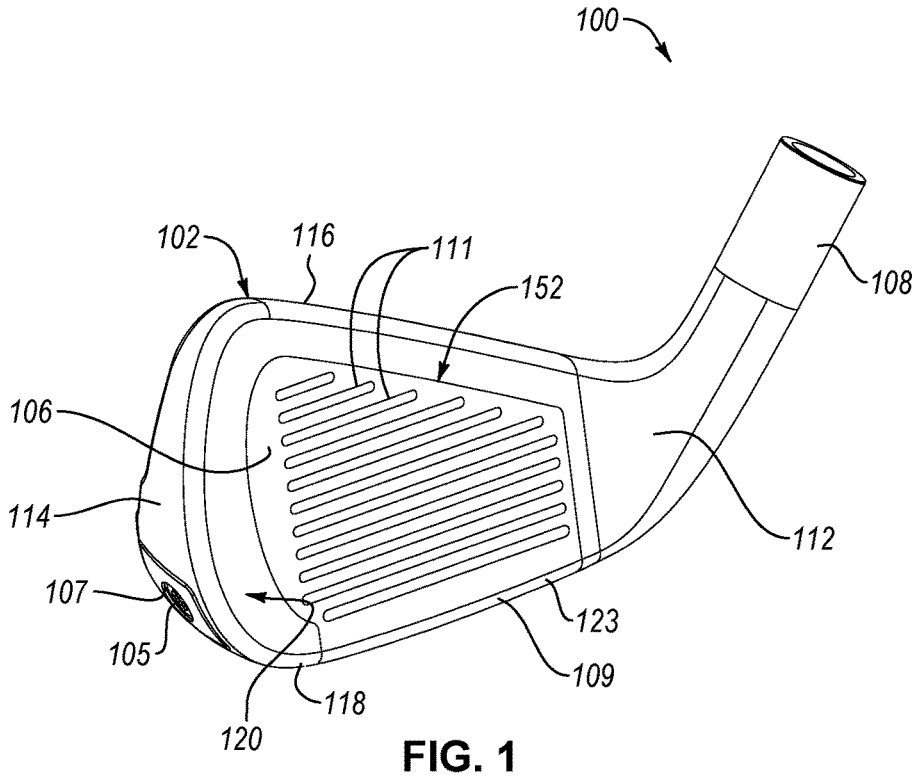
FIG. 1 is a perspective view of an iron-type golf club head, from a front of the golf club head, according to one or more examples of the present disclosure.
Figure 2:
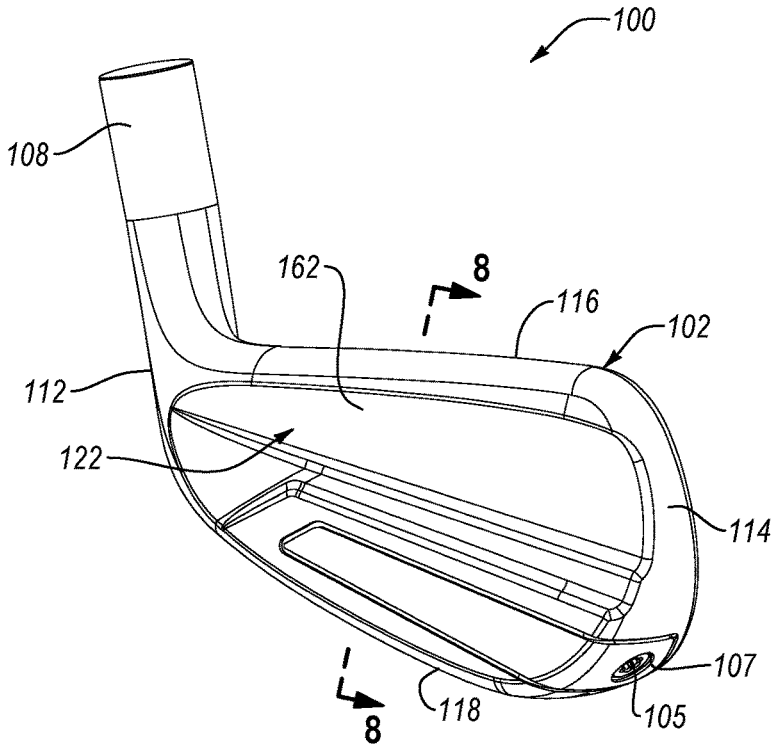
FIG. 2 is perspective view of the golf club head of FIG. 1, from a rear of the golf club head, according to one or more examples of the present disclosure.

Referring to FIGS. 1 and 2, one example of a golf club head 100 is shown. The golf club head 100 is a hollow-body-type golf club head that includes a body 102. The body 102 has a toe portion 114, a heel portion 112, a top portion 116 (e.g., top-line portion), and a sole portion 118 (e.g., bottom portion). Additionally, the body 102 includes a hosel 108 that extends from the heel portion 112 of the body 102. The hosel 108 is configured to receive and engage with a shaft and grip of a golf club. As shown in FIGS. 1, 2, 7A, and 7B, in some examples, the golf club head 100 includes a ferrule 187 that helps secure the shaft to the hosel 108. The ferrule 187 is a ring-shaped structure with a portion received within the hosel 108 and having a central bore that receives an end of the shaft. In some examples, the ferrule 187 has a one-piece, monolithic, construction, which promotes rigidity and strength of the coupling between the shaft and the hosel 108. The shaft extends from the hosel 108 and the grip is secured to the shaft at a location on the shaft opposite that of the golf club head 100. In certain examples, the hosel 108 includes a hosel slot proximate the heel portion 112 of the body 102 of the golf club head 100. The ferrule 187 can be replaced by an adjustable head-shaft connection system, such as disclosed in U.S. Pat. No. 8,622,847, which is hereby incorporated by reference, to help adjust the launch characteristics of the golf club head 100.

The body 102 also includes a front portion 120 and a rear portion 122. The front portion 120 includes a strike face 106 designed to impact a golf ball during a normal golf swing. The strike face 106 has a face length (LF) that is equal to the distance between a par line 195 of the golf club head 100 and a toewardmost point of the golf club head 100 as shown in FIG. 3. The par line 195 is defined as the theoretical line defining the transition on the front portion 120 between a flat surface to a curved surface generally proximate to the heel end of the golf club head. Put another way, the par line 195 defines where the flat surface of the front portion 120 ends and the curved surface of the front portion 120 begins. In some examples, the face length (LF) is equal to or less than 74 mm (e.g., equal to or less than 70.5 mm).

The rear portion 122 includes a rear wall 162 opposite the strike face 106. The rear wall 162 is co-formed with the rear portion 122 to form a one-piece, seamless, and unitary monolithic construction with the rear portion 122. The body 102 further includes an internal cavity 132 that is define as the space between the toe portion 114, the heel portion 112, the top portion 116, the sole portion 118, the front portion 120, and the rear portion 122.

In some examples, the golf club head 100 is configured with dimensions similar to a blade-style golf club head. For example, an offset, in a front-to-rear direction, between a forwardmost portion of the hosel 108 and a leading edge 109 of the strike face 106 is between 1.5 mm and 4.0 mm, preferably less than 3.5 mm. According to another example, a blade length (LB) of the body 102 is between 73 mm and 83 mm, preferably between 76 mm and 80 mm. In yet another example, an overall width of the sole portion 118 is between 19 mm and 26 mm, preferably between 22 mm and 25 mm, at the toe and between 14 mm and 21 mm, preferably between 15 mm and 20 mm, at the heel.

As used herein, the blade length (LB) of the golf club head 100 is the distance between a ground plane intersection point (GPIP) and the toewardmost point of the golf club head 100, when the golf club head 100 is in proper address position on the ground plane 191, which includes the grooves 111 being parallel to the ground plane 191 (see, e.g., FIG. 3). The GPIP is defined as the intersection of the ground plane 191 and a central axis 193 of the hosel 108 when the golf club head 100 is in proper address position on the ground plane 191.

Generally, for many iron-type golf club heads, such as the golf club head 100, the strike face 106 has a planar surface that is angled relative to a ground plane when the golf club head 100 is in an address position to define a loft of the golf club head 100. In other words, the strike face 106 of an iron-type golf club head generally does not include a curved surface. Accordingly, the strike face 106 of the iron-type golf club head 100 is defined as the portion of the strike face 106 with an outwardly facing planar surface. The front portion 120 further includes grooves 111 formed in the strike face 106 to promote desirable flight characteristics (e.g., back-spin) of the golf ball upon being impacted by the strike face 106.

The strike face 106 of the golf club head 100 is formed separately from the rest of the body 102 and attached to the rest of the body 102, such as via a weld. More specifically, the strike face 106 is defined by a strike plate 152 that is separately formed and welded to the front portion 120 of the body 102. In some examples, the strike face 106 includes undulations as shown and described in U.S. patent application Ser. No. 16/160,974, filed Oct. 15, 2018, and U.S. patent application Ser. No. 16/160,884, filed Oct. 15, 2018, which are both incorporated herein by reference in their entirety.

Figure 6:
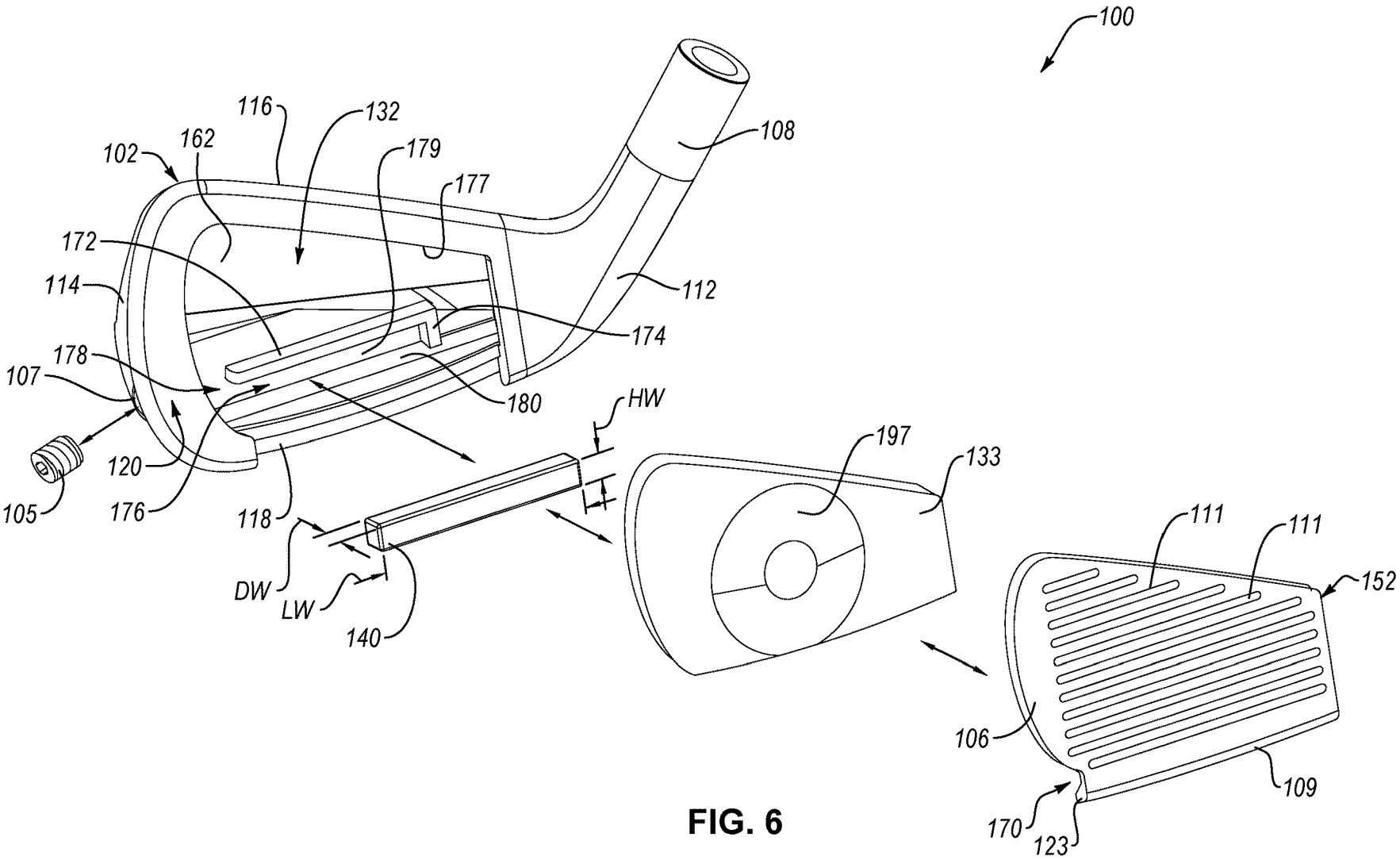
FIG. 6 is an exploded perspective view of the golf club head of FIG. 1, according to one or more examples of the present disclosure.

Referring to FIG. 6, the strike plate 152 is formed separately from the rest of the front portion 120 of the body 102 and is separately attached to the front portion 120 of the body 102. Notwithstanding the strike plate 152 forming part of the body 102, unless otherwise noted, for convenience, reference to the body 102 will refer to the portions of the body 102 excluding the strike plate 152. The body 102 and the strike plate 152 can be formed using the same type of process or different types of processes. In the illustrated example, the body 102 is formed to have a one-piece, seamless, unitary monolithic construction using a first manufacturing process and the strike plate 152 is formed to have a separate one-piece, seamless, unitary monolithic construction using a second manufacturing process. However, in other examples, one or both of the body 102 and the strike plate 152 has a multiple-piece construction with each piece being made from the same or a different material. Additionally, the body 102 can be formed of the same material as or a different material than the strike plate 152. The body 102 is made from a first material and the strike plate 252 is made from a second material. Separately forming and attaching together the body 102 and the strike plate 152 and making the body 102 and the strike plate 152 from the same or different materials, which allows flexibility in the types of manufacturing processes and materials used, promotes the ability to make a golf club head 100 that achieves a wide range of performance, aesthetic, and economic results.

In some implementations, the first manufacturing process is the same type of process as the second manufacturing process. For example, both the first and second manufacturing processes are casting processes in one implementation. As another example, both the first and second manufacturing processes are forging processes in one implementation. According to yet another example, both the first and second manufacturing processes are machining processes in one implementation.

However, in some other implementations, the first manufacturing process is a different type of process than the second manufacturing process. The first manufacturing process is one of a casting process, a machining process, and a forging process and the second manufacturing process is another of a casting process, a machining process, and a forging process in some examples. In one particular example, the first manufacturing process is a casting process and the second manufacturing process is a forging process. The first manufacturing process and/or the second manufacturing process can be a process as described in U.S. Pat. No. 9,044,653, which is incorporated herein in its entirety, such as hot press forging using a progressive series of dies and heat-treatment.

Whether the first and second manufacturing processes are the same or different, the first material of the body 102 can be the same as or different than the second material of the strike plate 152. A first material is different than a second material when the first material has a different composition than the second material. Accordingly, materials from the same family, such as steel, but with different compositional characteristics, such as different carbon constituencies, are considered different materials. In one example, the first and second manufacturing processes are different, but the first and second materials are the same. In contrast, according to another example, the first and second manufacturing processes are the same and the first and second materials are different. According to yet another example, the first and second manufacturing processes are different and the first and second materials are different. In some implementations, the first and second materials are different, but come from the same family of similar materials, such as titanium or steel.

In some examples, the second material of the strike plate 152 is different than, but in the same family as, as the first material of the body 102. The first material, being within the same family as the second material, promotes the quality of the weld between the body 102 and the strike plate 152. However, in other examples, the second material of the strike plate 152 is different than and in a different family as the first material of the body 102. For example, the material of the body 102 can be a titanium alloy and the material of the strike plate 152 can be a steel alloy or a fiber-reinforced polymeric composite material.

Figure 8:
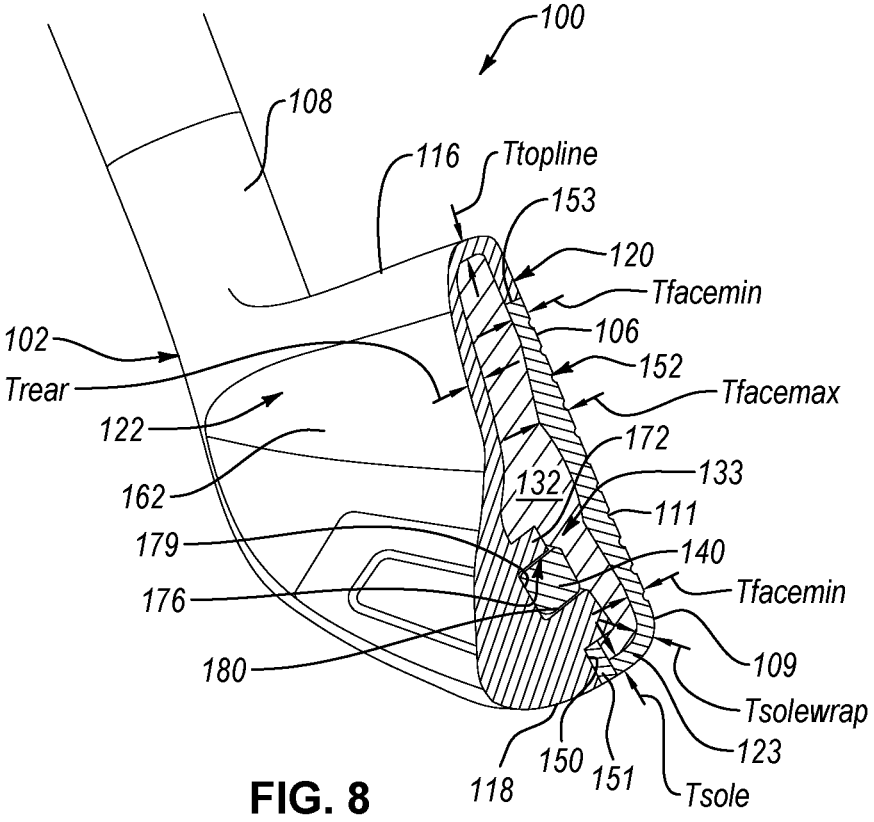
FIG. 8 is a cross-sectional perspective view of the golf club head of FIG. 1, taken along the line 8-8 of FIG. 2, according to one or more examples of the present disclosure.
Figure 9:
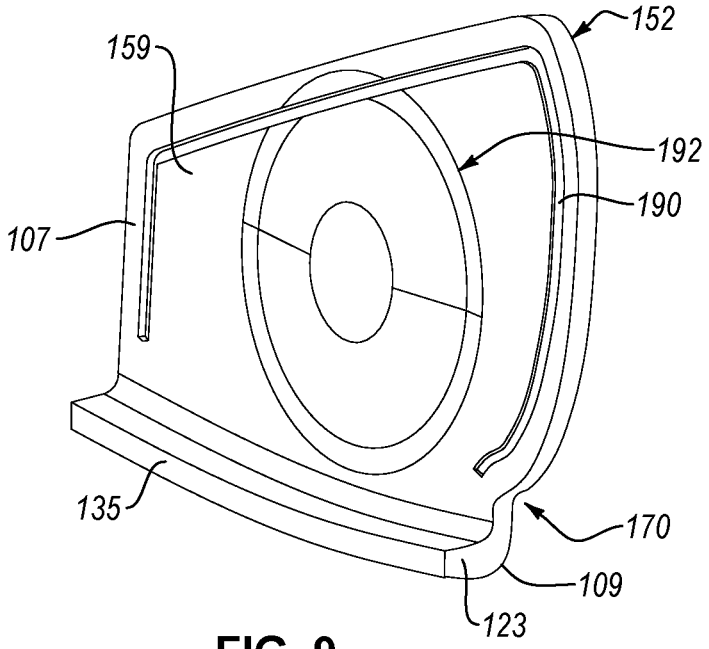
FIG. 9 is a perspective view of a strike plate of the golf club head of FIG. 1, according to one or more examples of the present disclosure.

According to some examples, the strike plate 152 is welded to the body 102 via a peripheral weld, such as the peripheral weld 153 (see, e.g., FIG. 8). The peripheral weld 153 can be peripherally continuous (extends about all of the outer periphery of the strike plate 152). However, in the illustrated examples, the peripheral weld 153 is peripherally discontinuous (extends about less than all of the outer periphery of the strike plate 152 such that at least one portion of the outer periphery of the strike plate 152 is not welded to the body 102). For example, as shown in FIGS. 8-10, the strike plate 152 includes a sole wrap portion 123 that is not welded to the body 102. More specifically, an outer peripheral edge 135, or perimeter, of the strike plate 152 defined along the sole wrap portion 123 of the strike plate 152 is not welded to the body 102. The sole wrap portion 123 effectively wraps around the sole portion 118 of the body 102 to define a portion of the bottom or the sole portion 118 of the golf club head 100. Accordingly, the sole wrap portion 123 is angled relative to the strike face 106. In some examples, as shown in FIG. 10, the sole wrap portion 123 also effectively wraps around (e.g., is vertically underneath when the strike face 106 is perpendicular to the ground plane 191) an internal shelf 180 of the sole portion 118.

Figure 11:
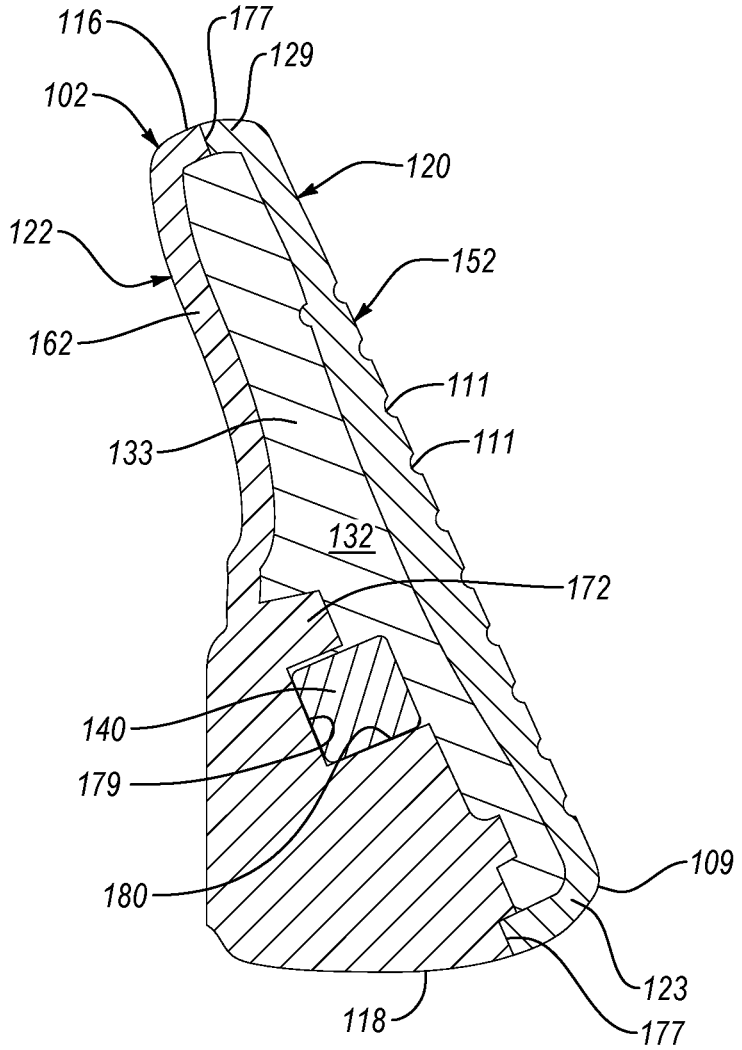
FIG. 11 is a cross-sectional side view of a golf club head, taken along a line similar to the line 8-8 of FIG. 2, according to one or more examples of the present disclosure.
Figure 12:
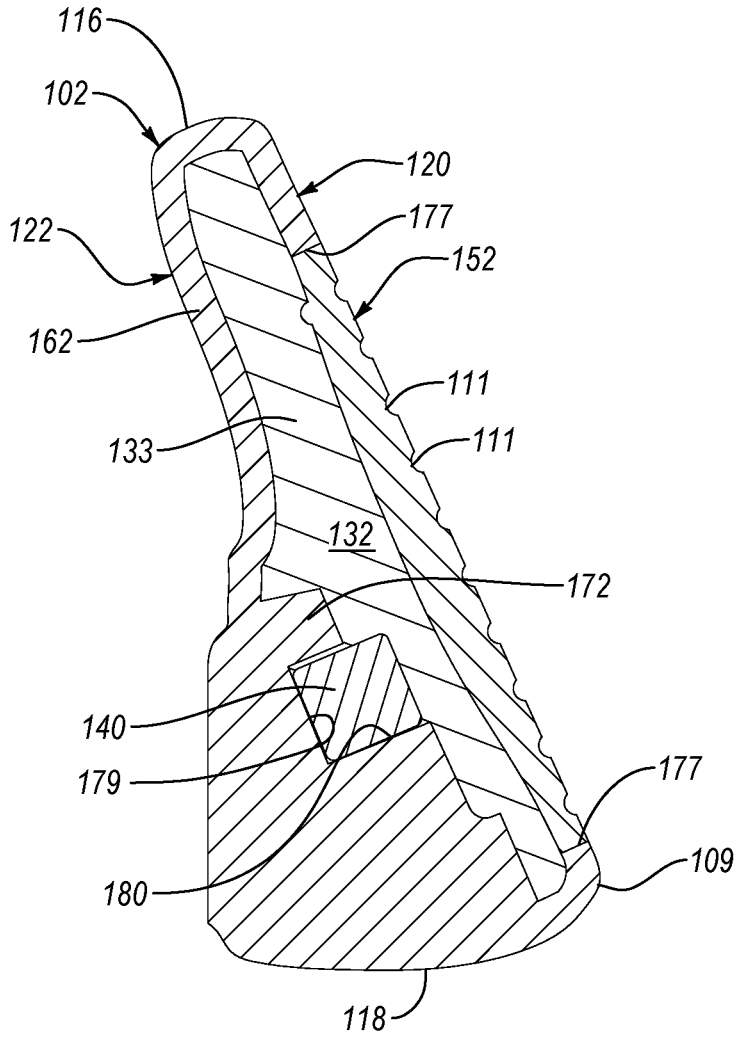
FIG. 12 is a cross-sectional side view of a golf club head, taken along a line similar to the line 8-8 of FIG. 2, according to one or more examples of the present disclosure.

As shown in FIG. 11, in some examples, the strike plate 142 includes the sole wrap portion 123 and further includes a top wrap portion 129. The top wrap portion 126 forms a part of the top portion 116 of the body 102 in a manner similar to the sole wrap portion 123 forming a part of the sole portion 118. In contrast, according to certain examples as shown in FIG. 12, the strike plate 142 has neither a sole wrap portion 123 nor a top wrap portion 129, such that no portion of the strike plate 142 forms part of the top portion 116 or the sole portion 118.

Referring to FIGS. 6 and 9, in some examples, the strike plate 152 also includes a jog feature 170 (e.g., notch) on a toeward side of the strike plate 152. The jog feature 170 defines a transition from the peripheral edge of the sole wrap portion 123 to the peripheral edge of the toe portion of the strike plate 152. The jog feature 170 promotes a part of the strike plate 152 extending further toeward than the sole wrap portion 123. Accordingly, the jog feature 170 defines an intersection between the sole wrap portion 123 and the part of the strike plate 152 that extends toeward of the sole wrap portion 123.

Figure 5:
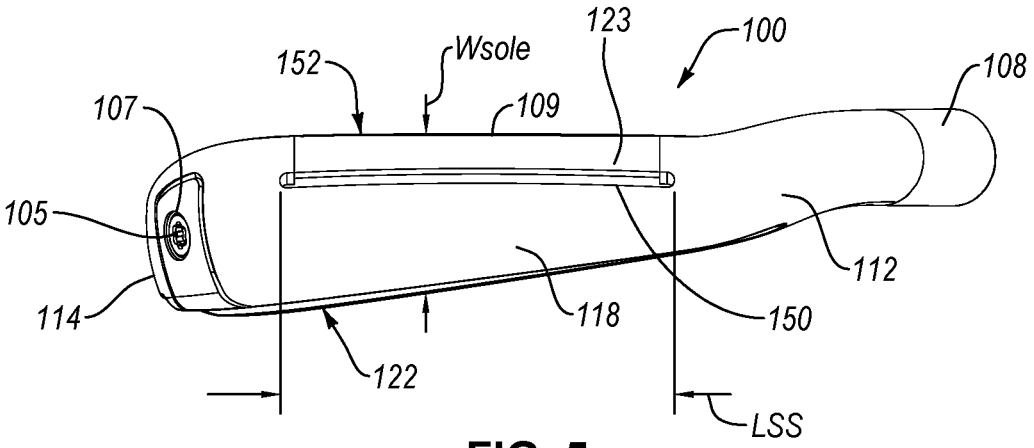
FIG. 5. Is a bottom view of the golf club head of FIG. 1, according to one or more examples of the present disclosure.

Not only is the outer peripheral edge 135 of the sole wrap portion 123 of the strike plate 152 not welded to the body 102, but the outer peripheral edge of the sole wrap portion 123 is spaced apart from the body 102 such that a gap is defined between the outer peripheral edge 135 of the strike plate 104 and the body 102. The gap defines a sole slot 150 of the golf club head 100. Generally, the sole slot 150 is a groove or channel formed in a sole of the golf club head 100. The sole slot 150 is elongated in a lengthwise direction, substantially parallel to the strike face 106, and has a length LSS (see, e.g., FIG. 5). In the illustrated examples, the sole slot 150 is a through-slot, or a slot that is open on a sole portion side of the sole slot 150 and open on an internal cavity side or interior side of the sole slot 150. However, in other examples, the sole slot 150 is not a through-slot, but rather is closed on an internal cavity side or interior side of the sole slot 150.

The sole slot 150 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100.

In some examples, the sole slot 150 is filled with a filler material 151 (see, e.g., FIGS. 8 and 11). The filler material 151 is made from a non-metal, such as a thermoplastic material, thermoset material, and the like, in some implementations. Accordingly, the filler material 151 does not weld the sole wrap portion 123 to the body 102. In other implementations, the sole slot 150 is not filled with a filler material 151, but rather maintains an open, vacant, space within the sole slot 150. According to some examples, the filler material 151 is initially a viscous material that is injected or otherwise inserted into the sole slot 150. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some examples, a solid filler material may be press-fit or adhesively bonded into the sole slot 150. In other examples, a filler material may poured, injected, or otherwise inserted into the sole slot 150 and allowed to cure in place, forming a sufficiently hardened or resilient outer surface. In still other examples, a filler material may be placed into the sole slot 150 and sealed in place with a resilient cap or other structure formed of a metal, metal alloy, metallic, composite, hard plastic, resilient elastomeric, or other suitable material.

Although in the above examples, the sole wrap portion 123 of the strike plate 152 is not welded to the body 102, such that a sole slot 150 is formed, according to other examples, the sole wrap portion 123 is welded to the body 102 and the golf club head 100 does not include a sole slot 150 (see, e.g., FIG. 11). The sole wrap portion 123 is welded along the sole portion 118 at a location between approximately 4 mm and approximately 11 mm rearward of the leading edge 109. The omission of a sole slot 150 in the sole portion 118 may provide an aesthetic look and feel that is preferred by some players.

Additionally, as shown in FIG. 12, in certain examples, the strike plate 152 does not include a sole wrap portion 123 such that the bottom of the strike plate 152 is welded to the front portion 120 above the leading edge 109. In such examples, the sole portion 118 can include a sole slot or, as depicted in FIG. 12, not include a sole slot. Furthermore, with reference to FIG. 11 as mentioned above, according to some examples, the strike plate 152 includes a crown or top wrap portion 129 that at least partially wraps around the top of the face portion 120 to define a part of the top portion 116 of the body 102. A crown or top wrap portion may be beneficial to avoid weld burn through which can be caused when welding on the face. To avoid weld-burn-through a minimum internal cavity depth of at least 1.0 mm is desired. However, this is not necessary in the case of a strike plate with a top wrap portion.

The body 102 is configured to receive the portions of an outer peripheral edge of the strike plate 152, to be welded to the body 102 via the peripheral weld 153. The front portion 120 of the body 102 includes a face opening 177 defined between the toe portion 114, the heel portion 112, the top portion 116, and the sole portion 118 of the body 102. Generally, the face opening 177 receives the strike plate 152 and helps to secure the strike plate 152 to the body 102. The face opening 177 extends entirely through the front portion 120 and is open to an internal cavity 132 of the body 102. The strike plate 152 in effect covers the face opening 177, thus enclosing the internal cavity 132 and forming the hollow body of the golf club head 100.

Although not shown, the front portion 120 of the body 102 can additionally include a plate interface formed along at least a portion of the periphery of the face opening 177. The plate interface promotes attachment of the strike plate 152 to the body 102 by supporting the strike plate 152 against the body 102 and promoting the formation of the peripheral weld 153 between the strike plate 152 and the body 102. Accordingly, the plate interface is formed along at least the portion or portions of the periphery of the face opening 177 to which the strike plate 152 is welded. The plate interface can include a rim and a ledge. The rim defines a surface that faces an interior of the body 102 and the ledge defines a surface that faces the front of the body 102. The rim is transverse relative to the ledge and sized to be substantially flush against or just off of the outer peripheral edge of the strike plate 152. The fit between the rim of the plate interface and the outer peripheral edge of the strike plate 152 facilitates the butt welding together of the rim and the outer peripheral edge of the strike plate 152 with the peripheral weld 153.

The peripheral weld 153 is formed using any of various welding techniques, such as those disclosed in U.S. Pat. No. 8,353,785, which is incorporated herein by reference in its entirety. Moreover, the characteristics and type (e.g., bead, groove, fillet, surface, tack, plug, slot, friction, and resistance welds) of the peripheral weld 153 can be that same or analogous to those described in U.S. Pat. No. 8,353,785. For example, in one implementation, the peripheral weld is formed using one or more of a tungsten inert gas (TIG) or metal inert gas (MIG) welding technique. In other implementations, the peripheral weld is formed using one or more of a laser welding technique or a plasma welding technique.

Referring to FIGS. 8 and 9, according to certain examples, the strike plate 152 includes a weld guide 190 protruding from an internal surface 159 of the strike plate 152. The weld guide 190 extends along the outer peripheral edge of the strike plate 152 at a location offset from the outer peripheral edge. The weld guide 190 provides a visual guide for locating an ideal weld bead and helps an inspector determine the quality of the peripheral weld 153 by comparing the peripheral weld 153 to the weld guide 190 using an X-Ray machine. In some examples, a corresponding weld guide may be located on the front portion of the strike plate to further help locate the weld placement. Any front weld guide and weld bead would later be ground off.

Figure 7A:
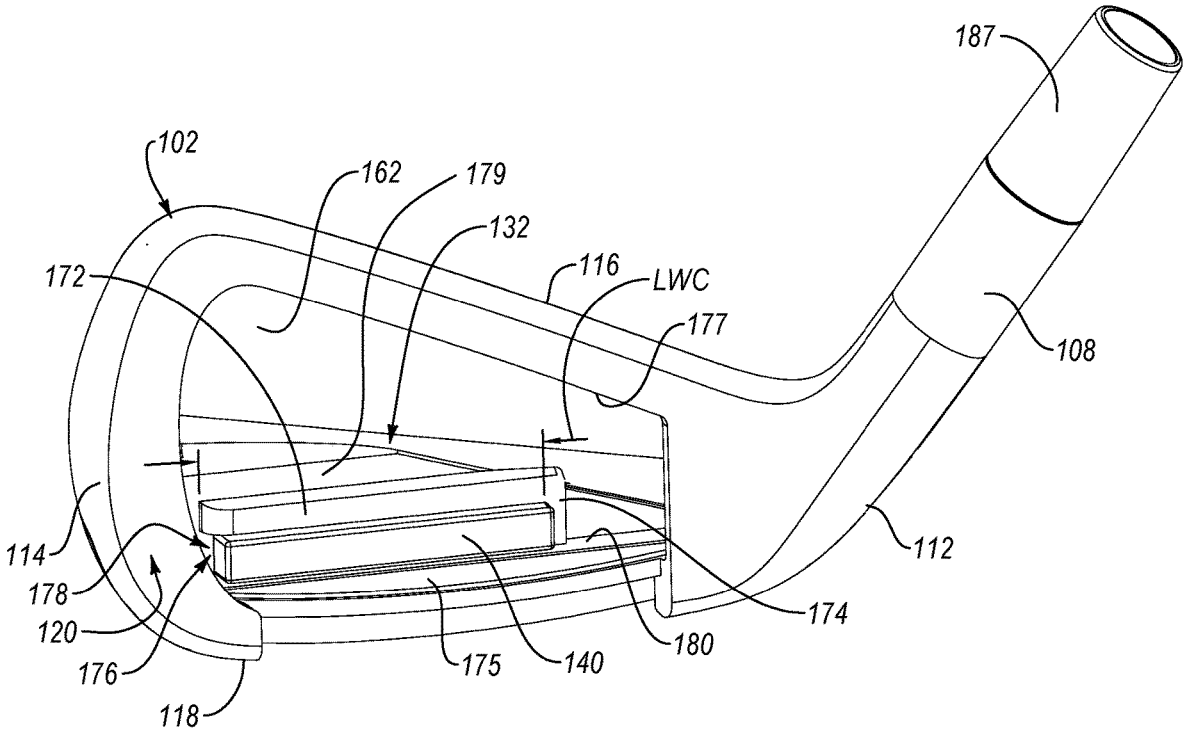
FIG. 7A is a perspective view of the golf club head of FIG. 1, with a strike plate and filler material removed, according to one or more examples of the present disclosure.
Figure 7B:
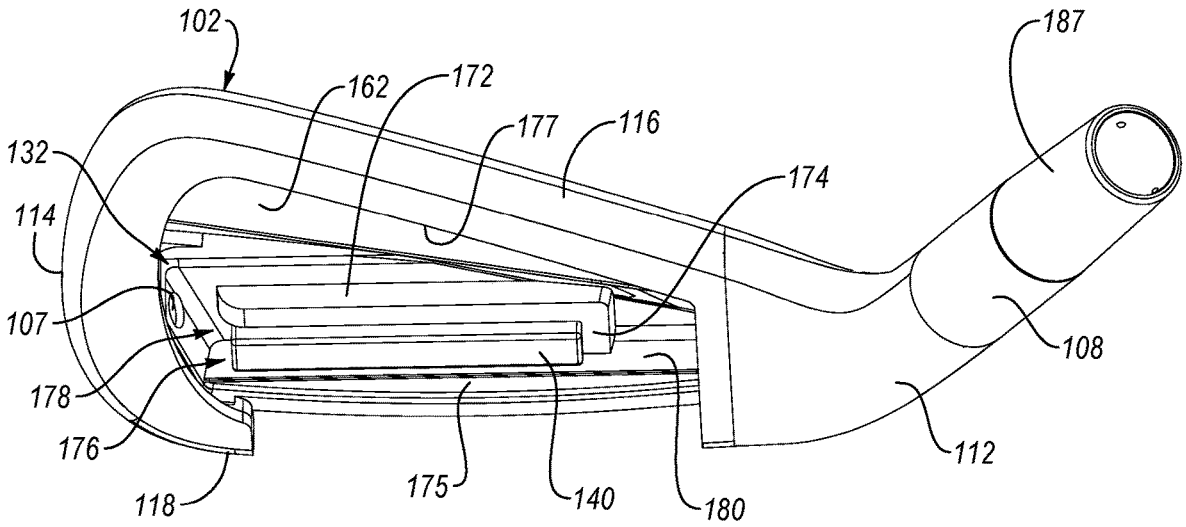
FIG. 7B is a perspective view of the golf club head of FIG. 1, with a strike plate and filler material removed, according to one or more examples of the present disclosure.

Referring to FIGS. 6, 7A, and 7B, the internal shelf 180 defines a horizontal surface (e.g., when the golf club head 100 is in the proper address position) that extends substantially parallel to the strike face 106 or in a heel-to-toe direction. With the internal shelf 180 formed in the sole portion 118, the internal shelf 180 is below the geometric center 182 of the strike face 106. The internal shelf 180 is rearwardly offset from the internal surface 159 of the strike plate 152 and extends from a back-constraining wall 179 formed in the sole portion 118. As shown in FIG. 10, the internal shelf 180 extends a distance (DIS) forwardly from the back-constraining wall 179. In some examples, at least a portion of the internal shelf 180 is formed in an upper surface of an internal overhang 175 (e.g., second overhang) that overhangs a portion of the sole portion 118 in a direction substantially parallel to the strike face 106. The internal overhang 175 extends forwardly from the back-constraining wall 179. As shown in FIGS. 7A and 7B, the internal shelf 180 is configured to receive and directly support the weight 140. In other words, the weight 140 is attached to and lays flat against the internal shelf 180 as will be explained in more detail.

The internal shelf 180 also partially defines a weight channel 176 within the internal cavity 132 of the body 102. The weight channel 176 is enclosed within the internal cavity 132 but is open to the internal cavity 132 on a front side and a toeward side of the weight channel 176. In contrast, the weight channel 176 is closed to the internal cavity 132 on a bottom side, back side, top side, and heelward side of the weight channel 176. Accordingly, the weight channel 176 has a closed bottom side, a closed back side, a closed top side, a closed heelward end, an open toeward end, and an open front side. The bottom side of the weight channel 176 is defined by the internal shelf 180 of the sole portion 118. The back side of the weight channel 176 is defined by the back-constraining wall 179 of the sole portion 118. The top side of the weight channel 176 is defined by an upper-constraining wall 172 (e.g., first overhang) that protrudes forwardly from the back-constraining wall 179 towards the strike face 106 a distance (DUCW). The upper-constraining wall 172 is vertically offset from the internal shelf 180. The heelward side of the weight channel 176 is defined by a side-constraining wall 174 that also protrudes forwardly from the back-constraining wall 179 towards the strike face 106 and is adjoined with the upper-constraining wall 172 and the internal shelf 180. The body 102 does not include a side-constraining wall at the toeward side of the weight channel 176. Accordingly, the weight channel 176 includes an open toeward end 178 at the toeward side of the weight channel 176. The weight channel 176 has a length (LWC) that extends from the open toeward end 178 to the closed heelward end. The weight channel 176 is elongated with its length (LWC) extending parallel to the strike face 106.

Referring to FIGS. 7A and 7B, the weight 140 is seated within the weight channel 176. For example, the weight 140 is seated against the internal shelf 180, the back-constraining wall 179, the upper-constraining wall 172, and the side-constraining wall 174. In certain examples, the weight 140 is retained in seated engagement with the weight channel 176 by attaching the weight 140 to the surfaces of the internal shelf 180, the back-constraining wall 179, the upper-constraining wall 172, and the side-constraining wall 174 that define the weight channel 176. According to one example, the weight 140 is attached to the surfaces of the weight channel 176 by adhering or adhesively bonding (e.g., gluing, such as with glue or epoxy) the weight 140 to at least one of the surfaces. In another example, the weight 140 is attached to the surfaces of the weight channel 176 by welding, brazing, soldering, or mechanically fastening the weight 140 to the surfaces. Other than an adhesive material or weldment, there is no intervening layers (e.g., damping material) between the weight 140 and the body 102 of the golf club head 100. A filler material 133 in the internal cavity 132, as will be described in more detail, can also help to retain the weight 140 in the weight channel 176 by encapsulating the weight 140 in the weight channel 176. But, because the weight 140 is seated in the weight channel 176, no portion of the filler material 133 is located behind the weight 140 between the weight 140 and the back-constraining wall 179 or under the weight 140 between the weight 140 and the internal shelf 180.

When retained in seated engagement with the weight channel 176, the weight 140 is proud of the upper-constraining wall 172 and the side-constraining wall 174. In other words, as shown in FIG. 10, the weight 140 is sized to extend out of the weight channel 176, beyond the upper-constraining wall 172 and the side-constraining wall 174, toward the strike face 106. Referring to FIG. 6, the weight 140 is elongated in the heel-to-toe direction. More specifically, the weight 140 has a length (LW), a height (HW), and a depth (DW), where the length (LW) is greater than each one of the height (HW) and the depth (DW). In certain implementations, the weight 140 is elongated and the length (LW) is at least four times, five times, six times, seven times, or eight times each one of the height (HW) and/or the depth (DW). Moreover, the length (LW) of the weight 140 is equal to or less than the length (LWC) of the weight channel 176 and the depth (DW) of the weight 140 is more than the distance (DUCW) of the upper-constraining wall 172 and less than the distance (DIS) of the internal shelf 180. In some examples, the height (HW) of the weight 140 and the depth (DW) of the weight 140 is between 4 mm and 6 mm, such as 5 mm. The weight 140 is situated in the weight channel 176 such that the length (LW) of the weight 140 is parallel to the strike face 106. Accordingly, when situated in this manner as shown in FIG. 10, the depth (DW) of the weight 140, being greater than the distance (DUCW), results in the weight 140 extending beyond the upper-constraining wall 172. Such an arrangement facilitates an improved center-of-gravity (CG) projection.

The length (LW) of the weight 140 is such that a toe portion of the weight 140 is located at least 20 mm toeward of the geometric center 182 of the strike face 106, a heel portion of the weight 140 is located at least 20 mm heelward of the geometric center 182 of the strike face 106, and a central portion (between the toe portion and a heel portion) of the weight 140 is located within 20 mm of the geometric center 182 of the strike face 106. In some examples, the center of gravity of the weight 140 is shifted toeward to offset the weight of the hosel 108 and shift the CG of the golf club head 100 closer to the geometric center 182 of the strike face 106, and in some cases toeward of the geometric center 182 of the strike face 106. According to certain examples, length (LW) a of the weight 140 is between 30 mm and 50 mm, such as 40 mm. In some examples, the length (LW) of the weight 140 is between 35% and 65% of a blade length LB of the body 102.

At proper address position, as shown in FIG. 10, the weight 140 is at a height (HWT) above the ground plane 191. In other words, no portion of the weight 140 is above the height (HWT) when the golf club head 100 is in the proper address position on the ground plane 191. Also, at proper address position on the ground plane 191, the geometric center 182 (e.g., center face) of the strike face 106 is at a height (HGC) above the ground plane 191. The height (HWT) of the weight 140 is less than the height (HGC) of the geometric center 182 of the strike face 106. Locating the weight 140 lower on the golf club head 100 (e.g., closer to the ground plane 191 when in proper address position) promotes a lower z-axis coordinate (e.g., z-up value) of the center of gravity of the golf club head 100. In some examples, the height (HWT) of the weight 140 is less than the z-axis coordinate of the center of gravity of the golf club head 100 (i.e., the z-up value of the golf club head 100). In certain examples, the z-axis coordinate of the center of gravity of the golf club head 100 is between 10 mm and 20 mm, such as between 17.9 mm and 19.2 mm.

The golf club head 100 includes a sole bar at a bottom-rear portion of the golf club head. In some examples, the sole bar has a front-to-back depth of at least 9 mm and a height from the ground plane 191, as shown in FIG. 10, of at least 9 mm. According to certain examples, the sole bar height is at least 10 to 20 times the thickness of the topline.

In some examples, the body 102, including the heel portion 112, the toe portion 114, the sole portion 118, the top portion 116, the front portion 120, the rear portion 122, and the strike plate 152 is made of a metal alloy, such as a steel alloy or a titanium alloy, or made of a non-metal material, such as a fiber-reinforced polymeric material.

As used herein, the steel alloy can be any of various steel alloys known in the art. For example, the steel alloy can be 8620 carbon steel or 1025 carbon steel. According to some examples, the strike plate 152 can be made from maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the strike plate 104. In other embodiments, the strike plate 104 is a precipitation hardened stainless steel such as 17-4, 15-5, or 17-7.

The body 102 of the golf club head 100, excluding the strike plate 152, is made from 17-4 steel in one implementation. However another material, such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

As used herein, the titanium alloy can be any of various titanium alloys. According to certain examples, the titanium alloy includes one or more of 9-1-1, 3-2.5, 6-4, SP700, 15-3-3-3, 10-2-3, or other alpha/near alpha, alpha-beta, and beta/near beta titanium alloys. The density of the titanium alloy is less than 8 grams-per-cubic centimeter in some examples.

In one example, the titanium alloy is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In another example, the titanium alloy is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8A1-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8A1-2.5Mo-2Cr-1V-0.5Fe alloy can have a tensile strength of about 1320 MPa, a yield strength of about 1284 MPa, and an elongation of about 10%. The Ti-8A1-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In addition to those noted above, some examples of metals and metal alloys that can be used to form the components of the parts described include, without limitation: aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 102 and/or the strike plate 152 of the golf club head 100 are made from fiber-reinforced polymeric composite materials, and are not required to be homogeneous. Examples of composite materials and golf club components comprising composite materials are described in U.S. patent application Ser. No. 13/111,715, filed May 19, 2011, which is incorporated herein by reference in its entirety.

The weight 140, in some examples, is made of a high-density material that is different than the materials of the body 102, including the strike plate 152. As defined herein, a high-density material is a material having a density of at least 7.5 grams-per-cubic-centimeter (g/cc) and a density greater than the density of the body 102, including the strike plate 152. In some examples, the density of the high-density material is at least 12 g/cc, 14 g/cc, or 16 g/cc. Various metal materials have qualifying densities. In some examples, the high-density material of the weight 140 is a tungsten alloy, which can be any one of various tungsten alloys. In one example, the weight 140 has a mass of at least 10 grams, at least 12 grams (e.g., 12.2 grams), or at least 13 grams (e.g., 13.5 grams). The total mass of the weight 140 can be at least 30% of the total mass of the golf club head 100, such as, for example, between 35% and 50% or preferably between 39% and 46% of the total mass of the golf club head 100. According to one example, the mass of the weight 140 is at least 2 times the mass of the filler material 133.

According to some examples, the weight 140 has a variable mass per unit length that varies along its length (LW). Additionally, in certain examples, the weight 140 has a variable density (e.g., tapers) along a length of the weight, such that, for example, the toe portion of the weight 140 has a greater density than the heel portion or central portion of the weight 140.

In the illustrated examples, a cross-sectional shape of the weight 140 is constant along the length (LW) of the weight 140. The cross-sectional shape of the weight 140 is square or rectangular in certain examples. However, the weight 140 can have a cross-sectional shape this is another standard shape or a non-standard complex shape. In some examples, a cross-sectional shape of the weight 140 varies along the length (LW) of the weight 140. The weight 140 is symmetrical in certain examples and non-symmetrical in other examples. More specifically, in some examples, both the mass distribution and the shape of the weight 140 can be symmetrical or non-symmetrical. The weight 140 has a one-piece, unitary and seamless, monolithic construction in some examples.

In certain examples of the golf club head 100, as shown in FIGS. 6, 8, and 10, the internal cavity 132 is partially or entirely filled with a filler material 133. According to certain examples, the total volume of the golf club head 100 is between 40 cc and 55 cc, such as between 47 cc and 51 cc, and the total volume of the filler material 133 in the internal cavity 132 is between 11 cc and 17 cc. In some implementations, the filler material 133 is made from a non-metal, such as a thermoplastic material, thermoset material, and the like. In other implementations, the internal cavity 132 is not filled with a filler material 133, but rather maintains an open, vacant, cavity within the club head.

According to some examples, the filler material 133 is initially a viscous material that is injected or otherwise inserted into the club head through an injection port 107 (see, e.g., FIGS. 1 and 6) located on the toe portion 114 of the golf club head 100. However, in other examples, the injection port 107 can be located anywhere on the golf club head 100, including the top portion 116, the rear portion 122 (e.g., the rear wall 162), the sole portion 118, the heel portion 112, the toe portion 114, or through the hosel 108. In certain examples, the injection port 107 is located in the toe portion 114, which includes a build-up of mass to accommodate the port. The injection port 107 has a length equal to a thickness of the toe portion 114, which in some examples is at least 7.0 mm. In certain examples, the injection port 107 is oriented such that a central axis extending through the injection port 107 does not intersect the front portion 106. However, in other examples, the injection port 107 is oriented such that its central axis intersects the front portion 106.

The injection port 107 can be sealed with a plug 105 after the filler material 133 is injected into the internal cavity 132. In one example, the plug 105 is a metallic plug that can be made from steel, aluminum, titanium, or a metallic alloy. According to an example, the plug 105 is an anodized aluminum plug that is colored a red, green, blue, gray, white, orange, purple, black, clear, yellow, or metallic color. In one example, the plug 105 is a different or contrasting color from the majority color located on the body 102 of the golf club head 100. In still other examples, the filler material 133 may be pre-formed and placed into the golf club head 100 and sealed in place with a plug, cover, resilient cap, or other structure formed of a metal, metal alloy, metallic, composite, hard plastic, resilient elastomeric, or other suitable material. According to certain examples, the plug 105 acts as a weight to affect the toeward weighting and corresponding performance characteristics of the golf club head 100. For example, the plug 105 can be selected from, and interchangeable with, one of several disparately weighted plugs to customize the performance characteristics of the golf club head 100. In one example, the plug 105 has a mass of between 0.2 grams and 15 grams, and in certain examples, the plug 105 is equal to or more than 3 grams. Accordingly, the plug 105 can be made of a low-density material, such as aluminum, or a high-density material, such as a tungsten alloy as disclosed herein.

Examples of materials that may be suitable for use as the filler material 133 to be injected or placed into the internal cavity 132 of the golf club head 100 include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some examples, the filler material 133 is a two-part polyurethane foam that is a thermoset and is flexible after it is cured. In one example, the two-part polyurethane foam is any methylene diphenyl diisocyanate (a class of polyurethane prepolymer) or silicone based flexible or rigid polyurethane foam. Referring to FIG. 6, whether injected or pre-formed and inserted into the internal cavity 132, the filler material 133 when hardened includes a recess 197 to accommodate the cone 192 of the strike plate 152. The filler material 133 can be any one or more of the filler materials, which have a density between 0.03 g/cc and 0.19 g/cc, disclosed in U.S. Pat. No. 8,088,025, which is incorporated herein by reference in its entirety.

However, as discussed above, in some examples, the filler material 133 is a two-part polyurethane foam that is a thermoset and is flexible after it is cured. In one example, the two-part polyurethane foam is any methylene diphenyl diisocyanate (a class of polyurethane prepolymer) or silicone based flexible or rigid polyurethane foam. In the case of a two-part polyurethane foam, the density of the filler material 133, after it is fully formed within the internal cavity 132, is at least 0.21 g/cc, such as between about 0.21 g/cc and about 0.71 g/cc or between about 0.22 g/cc and about 0.49 g/cc. In certain embodiments, the density of the filler material 133 is in the range of about 0.22 g/cc to about 0.71 g/cc, or between about 0.35 g/cc and 0.60 g/cc. The corresponding mass of the filler material 133, which is dependent on the volume of the internal cavity 132 in some examples, is between 2.5 grams and 10 grams, inclusively (e.g., greater than 4 grams and less than 7 grams or 8 grams)

in certain implementations. The density of the filler material 133 impacts the COR, durability, strength, and filling capacity of the club head. In general, a lower density material will have less of an impact on the COR of a club head. As mentioned, the density of the filler material 133 is the density after the filler material 133 is fully formed within and enclosed by the internal cavity 132.

In some examples, the filler material 133 includes two foams with different densities. According to one example, a foam with a higher density is injected and situated in a lower portion of the internal cavity 132, such as against the weight 140. Then, a foam with a lower density is injected and situated in a higher portion of the internal cavity 132 on top of the higher-density foam. Such a configuration helps to lower the z-up value of the golf club head 100, while still providing the benefits of foam as the filler material 133.

During development of the golf club head 100, use of a lower density filler material having a density less than 0.21 g/cc was investigated, but the lower density did not meet certain sound performance criteria. This resulted in using a filler material 133 having a density of at least 0.21 g/cc to meet sound performance criteria with minimal impact to COR as demonstrated in Table 1 below.

According to some examples, an internal volume of the golf club head 100 (i.e., the volume of the internal cavity 132 before the filler material 133 is added) is between about 5.5 cc and about 18 cc. Referring to FIG. 10, a width (WIC), or front-to-back depth) of the internal cavity 132 above the midplane (MP) of the golf club head 100, which is the plane parallel to the ground plane 191 and at a height above the ground plane 191 equal to one half the height of the tallest extent of the toe portion 114 from the ground plane 191 when the golf club head 100 is in the proper address position on the ground plane 191, varies between 1.4 mm and 13 mm, inclusive (e.g., between 1.5 mm and 12 mm, inclusive, or between 3.0 mm and 10 mm, inclusive). In some examples, a width of the internal cavity 132, above the midplane (MP) decreases and increases from a top of the internal cavity 132 towards the bottom of the internal cavity 132 and/or from the midplane (MP) toward the top of the internal cavity 132. The external volume of the golf club head 100 is between 40 cc and 55 cc in certain examples. Accordingly, the ratio of internal volume to external volume of the golf club head 100 is between 0.14 and 0.385 (e.g., between 0.22 and 0.36), inclusive. In some examples, a first width (WIC) of the internal cavity 132 above the midplane (MP) is greater than a second width (WIC) of the internal cavity 132 below the midplane (MP), and a third width (WIC) of the internal cavity 132 between the first width (WIC) and the second width (WIC) is greater than the first width (WIC) and the second width (WIC).

In some examples, a maximum front-to-back internal cavity depth proximate the topline portion of the internal cavity of the golf club is no more than 6 mm. In some examples, a minimum front-to-back internal cavity depth is no less than 1.0 mm. In some examples, the internal cavity has a minimum front-to-back depth above a midplane of the golf club head of no less than 1.0 mm, a first front-to-back depth proximate the midplane of the golf club head, a second front-to-back depth proximate a topline portion of the internal cavity of the golf club head, and a third front-to-back depth of the internal cavity located in halfway between the midplane of the golf club and the topline portion of the internal cavity, and the third front-to-back depth of the internal cavity may range between 55% to 195% of a maximum front-to-back internal cavity depth proximate the topline portion of the internal cavity.

In one example, the filler material 133 has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 1 below provides examples of the COR change relative to a calibration plate of multiple club heads having the construction of the golf club head 100 disclosed herein in both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 1

COR Values Relative to a Calibration Plate

| Example No. | Unfilled COR Relative to Calibration Plate | Filled COR Relative to Calibration Plate | COR Change Between Filled and Unfilled |
|---|---|---|---|
| 1 | −0.019 | −0.022 | −0.003 |
| 2 | −0.003 | −0.005 | −0.002 |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0 |
| 9 | −0.012 | −0.014 | −0.002 |
| 10 | −0.020 | −0.022 | −0.002 |
| Average | −0.0119 | −0.022 | −0.002 |

Table 1 illustrates that before the filler material 133 is introduced into the internal cavity 132 of golf club head 100, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one example, the average COR drop off or loss relative to the calibration plate for a plurality of Unfilled COR golf club head within a set of irons is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 1 further illustrates that after the filler material 133 is introduced into the internal cavity 132 of golf club head 100, a Filled COR drop off relative to the calibration plate (or second COR drop off value) is more than the Unfilled COR drop off relative to the calibration plate. In other words, the addition of the filler material 133 in the Filled COR golf club heads slows the ball speed (Vout-Velocity Out) after rebounding from the face by a small amount relative to the rebounding ball velocity of the Unfilled COR heads.

In some examples shown in Table 1, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. According to one example, a COR change value (e.g., the difference between a measured COR value of the iron-type golf club head 100 and a United States Golf Association (USGA)-governed calibration plate COR value) of the golf club head 100 is at least −0.025.

In one example, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 1 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some examples, the COR change value is no more than 0.1, no more than 0.05, no more than 0.04, no more than 0.03, no more than 0.02, no more than 0.01, no more than 0.009, no more than 0.008, no more than 0.007, no more than 0.006, no more than 0.005, no more than 0.004, or no more than 0.003.

In some examples, at least one, two, three or four iron golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other examples, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other examples, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

A minimum COR of the golf club head is preferably no less 0.80, such as no less than 0.81, such as no less than 0.815, such as no less than 0.82.

In certain examples, the golf club head 100 is configured to facilitate tuning of the characteristic time (CT) of the golf club heads after production of the golf club heads, as shown and described in U.S. Provisional Patent Application No. 62/846,492, filed May 10, 2019, which is incorporated herein by reference in its entirety. For example, the filler material in the internal cavity of the golf club heads can be the same as or similar to those disclosed in U.S. Provisional Patent Application No. 62/846,492.

The golf club head 100, having a hollow internal cavity, provides several advantages, such as an increased forgiveness for off-center hits on the strike face. In some examples, the volume of the golf club head 100 is between about 10 cc and about 120 cc. In some examples, the golf club head 100 has a volume between about 20 cc and about 110 cc, such as between about 30 cc and about 100 cc, such as between about 40 cc and about 90 cc, such as between 45 cc and 55 cc, such as between about 50 cc and about 80 cc, and such as between about 60 cc and about 80 cc. In addition, in some examples, the golf club head 100 has an overall depth, equal to a maximum width $W_{sole}$ of the sole portion 118, that is between about 15 mm and about 100 mm. For example, in some examples, the golf club head 100 has an overall depth between about 20 mm and about 90 mm, such as between about 30 mm and about 80 mm and such as between about 40 mm and about 70 mm.

Referring to FIG. 8, the thicknesses of various portions of the golf club head 100 are shown. The golf club head 100 has a topline thickness $T_{topline}$, a face minimum thickness $T_{facemin}$, a face maximum thickness $T_{facemax}$, a sole wrap thickness $T_{solewrap}$, a sole thickness $T_{sole}$, and a rear thickness $T_{rear}$. The topline thickness $T_{topline}$ is the minimum thickness of the wall of the body defining the top portion 116 of the body 102 of the golf club head 100. The face minimum thickness $T_{facemin}$ is the minimum thickness of the strike plate 152 of the body 102. In contrast, the face maximum thickness $T_{facemax}$ is the maximum thickness of the strike plate 152 of the body 102. According to some examples, the face minimum thickness $T_{facemin}$, topline thickness $T_{topline}$, and rear thickness $T_{rear}$ are all generally less than a maximum face thickness located proximate to a central portion of the face, and preferably less than 2 mm, such as less than 1.8 mm, but more than 1.1 mm. According to certain examples, the golf club head 100 is configured to meet one or more of the ratios, between the thicknesses of the golf club head 100 and the volume of the filler material 133, disclosed in U.S. Patent Application Publication No. 2019/0143183, which is incorporated herein by reference in its entirety. As used herein, thicknesses of the face portion or strike plate exclude any grooves in the face portion or the strike plate. A ratio of the face thickness in mm to the filler material volume in cubic centimeters (cc) may range from 0.05 to 0.65.

In some examples, the strike plate 152 has a variable thickness such that the face minimum thickness $T_{facemin}$ is different than the minimum thickness of the strike plate 152 of the body 102. For example, as shown in FIG. 9, the strike plate 152 has a cone 192 on the internal surface 159 of the strike plate 152 that results in a variation in the thickness of the strike plate 152. The cone 192 can be centered on the geometric center 182 of the strike face 106 or toewardly offset from the geometric center 182. In some examples, the center of the cone 192 is inclusively between 3 mm and 8 mm (e.g., at least 4 mm or at least 6 mm toeward) of the geometric center 182, such that toeward portion of the cone 192 is more massive than heelward portion of the cone 192. This creates a more stiff toeward region, which helps create a draw bias. If one wished to create a fade bias one could move the center of the cone 192 heelward. Typically center of the cone 192 is more toeward (5-8 mm) for lower lofts e.g. less than 32 degrees and less toeward for greater lofts e.g. greater than 34 degrees.

The sole wrap thickness $T_{solewrap}$, is the minimum thickness of the wall of the strike plate 152 of the body 102 defining the transition between the front portion 106 and the sole portion 118 of the body 102 of the golf club head 100. However, in some examples the strike plate may not wrap onto the sole or the strike plate and body may be formed as a unitary monolithic construction, in which case the sole wrap thickness is simply the thickness proximate the transition between the front portion and the sole portion of the body, which some may refer to as a hinge region. The sole wrap thickness will generally blend into a similar sole thickness and similar face thickness. The sole thickness $T_{sole}$ is the minimum thickness of the wall of the strike plate 152 of the body 102 defining the sole portion 118 of the body 102 of the golf club head 100. The rear thickness $T_{rear}$ is the minimum thickness of the rear wall 162 of the body 102 of the golf club head 100. Additionally, the golf club head 100 has a maximum width $W_{topline}$ of the topline at the top portion 116 of the golf club head 100 that is between 5.0 mm and 9.0 mm in some examples, and between 5.7 mm and 6.5 mm in certain examples.

According to some examples, the topline thickness $T_{topline}$ is between 1.1 mm and 1.75 mm, inclusive (e.g., 1.6 mm), the face minimum thickness $T_{facemin}$ is between 1.1 mm and 2.7 mm, inclusive (e.g., between 1.3 mm and 2.0 mm, inclusive), the face maximum thickness $T_{facemax}$ is less than 3.7 mm, such as less than 3.0 mm or less than 2.85 mm, inclusive, the sole wrap thickness $T_{solewrap}$ is between 1.2 and 3.3 mm, inclusive (e.g., between 2.45 mm and 3.05 mm, inclusive), the sole thickness $T_{sole}$ is between 1.2 mm and 3.3 mm, inclusive (e.g., between 1.7 mm and 2.75 mm, inclusive), and/or the rear thickness $T_{rear}$ is between 1 mm and 3 mm, inclusive (e.g., between 1.8 mm and 2.2 mm, inclusive). In certain examples, a ratio of the sole wrap thickness $T_{solewrap}$ to the face maximum thickness $T_{facemax}$ is between 0.40 and 0.75, inclusive, a ratio of the sole wrap thickness $T_{solewrap}$ to the face maximum thickness $T_{facemax}$ is between 0.4 and 0.75, inclusive (e.g., between 0.44 and 0.64, inclusive, or between 0.49 and 0.62, inclusive), a ratio of the topline thickness $T_{topline}$ to the face maximum thickness $T_{facemax}$ is between 0.4 and 1.0, inclusive (e.g., between 0.44 and 0.64, inclusive, or between 0.49 and 0.62, inclusive), and/or a ratio of the sole wrap thickness $T_{solewrap}$ to the weight height HW is between 0.05 and 0.21, inclusive (e.g., between 0.07 and 0.15, inclusive).

According to some examples, the golf club head 100 includes additional features or is made from additional processes described in one or more of U.S. Pat. No. 8,535,177, issued Sep. 17, 2013; U.S. Pat. No. 8,845,450, issued Sep. 20, 2014; U.S. Pat. No. 8,328,663, issued Dec. 11, 2012; U.S. patent application Ser. No. 14/565,057, filed Dec. 9, 2014; U.S. Pat. No. 9,975,018, issued May 22, 2018; U.S. Pat. No. 9,044,653, issued Jun. 2, 2015; U.S. Pat. No. 9,033,819, issued May 19, 2015; U.S. Pat. No. 6,811,496, issued Nov. 2, 2004; U.S. patent application Ser. No. 15/649,508, filed Jul. 13, 2017; U.S. patent application Ser. No. 15/859,274 filed Dec. 29, 2017; U.S. patent application Ser. No. 15/394,549, filed Dec. 29, 2016; U.S. patent application Ser. No. 15/706,632, filed Sep. 15, 2017; U.S. patent application Ser. No. 16/059,801, filed Aug. 9, 2018; U.S. patent application Ser. No. 16/161,337, filed Oct. 16, 2018; U.S. patent application Ser. No. 16/434,162, filed Jun. 6, 2019; U.S. patent application Ser. No. 15/681,678, filed Aug. 21, 2017; U.S. Pat. No. 8,088,025, issued Jan. 3, 2012; U.S. Pat. No. 10,155,143, issued Dec. 18, 2018; U.S. Pat. No. 9,731,176, issued Aug. 15, 2017, which are all incorporated herein by reference in their entirety. Some features of the golf club head 100 are similar to the features of the iron-type golf club head shown and described in U.S. patent application Ser. No. 15/706,632, filed Sep. 15, 2017, which is incorporated herein in its entirety.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some examples, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An iron-type golf club head, comprising:

a body, made of a body material having a body material density, wherein the body comprises:
- a heel portion;
- a toe portion;
- a sole portion, comprising an internal shelf;
- a top portion;
- a front portion, comprising a face opening; and
- a rear portion, comprising a rear wall extending from the sole portion to the top portion;

a strike plate with a face maximum thickness Tfacemax, made of a strike plate material different than the body material, welded to the body and covering the face opening and thereby creating a strike face having a geometric center;

a weight, made of a weight material having a weight density greater than the body material density, at least partially seated on the internal shelf and configured such that no portion of the weight defines an exterior surface of the golf club head, and the weight does not contact the strike plate;

an internal cavity, having an internal cavity volume defined by the sole portion, the top portion, the strike face, and the rear portion; and an elastomer filler material, located within the internal cavity;

wherein:
- the golf club head has an external club head volume ranging between 40 cc to 55 cc, a ratio of the internal cavity volume to an external club head volume is at least 0.14, and the internal cavity volume is no more than 20 cc;
- the golf club head has a maximum topline width Wtopline of 5.0-9.0 mm;
- the golf club head has a blade length (LB) of 73-83 mm;
- the weight has a weight height (HW), a weight depth (DW), a weight length (LW) that is greater than the weight depth (DW), and the weight length (LW) is no more than 65% of the blade length (LB);
- the weight density is at least 12 g/cc and the weight has a mass of at least 10 grams;
- the internal cavity has a topline-adjacent internal cavity depth proximate the top portion that is no more than 6 mm;
- a midplane is located halfway between a maximum toe height and a ground plane when the golf club head is in an address position, the internal cavity extends below the midplane and above the midplane, and above the midplane the internal cavity comprises:
  - an above midplane maximum front-to-back cavity depth that is no more than 13 mm; and
  - an above midplane minimum front-to-back cavity depth that is less than the above midplane maximum front-to-back cavity depth;
- the elastomer filler material extends above the midplane, and below the midplane; and
- an offset, in a front-to-rear direction, between a forwardmost portion of a hosel and a leading edge of the strike face is less than 4.0mm.

2. The iron-type golf club head of claim 1, wherein the above midplane maximum front-to-back cavity depth is no more than 12 mm, and the ratio of the internal cavity volume to the external club head volume is at least 0.22.

3. The iron-type golf club head of claim 2, wherein the strike plate further comprises a sole wrap portion that defines a part of the sole portion and forms a portion of the internal cavity, no portion of the sole wrap portion is welded to the sole portion at a location more than 11 mm rearward of a leading edge of the strike plate, the elastomer filler material contacts the sole wrap portion, and a sole wrap thickness Tsolewrap of the sole wrap portion is no more than 3.3 mm.

4. The iron-type golf club head of claim 3, wherein a center of gravity of the weight is located toeward of the geometric center of the strike face.

5. The iron-type golf club head of claim 4, further including an injection port extending through the toe portion to the internal cavity, a plug seals the injection port and has a plug mass of less than 15 grams, and the plug is located below the midplane.

6. The iron-type golf club head of claim 5, wherein the injection port has a port length of at least 7 mm.

7. The iron-type golf club head of claim 5, wherein a portion of the injection port opens to the internal cavity at an elevation above a portion of the weight.

8. The iron-type golf club head of claim 4, wherein the strike plate has a face minimum thickness Tfacemin of 1.1-2.7 mm, and the face minimum thickness Tfacemin is less than the face maximum thickness Tfacemax.

9. The iron-type golf club head of claim 8, wherein a portion of the weight is at least 20 mm toeward of the geometric center of the strike face.

10. The iron-type golf club head of claim 9, wherein a maximum weight height elevation (HWT) of the weight is less than a geometric center height (HGC) of the geometric center of the strike face.

11. The iron-type golf club head of claim 10, wherein the topline-adjacent internal cavity depth is no more than 4.5 mm.

12. The iron-type golf club head of claim 11, wherein a topline thickness Ttopline of the top portion is less than the face maximum thickness Tfacemax.

13. The iron-type golf club head of claim 11, wherein a portion of a peripheral weld along a top perimeter of the strike plate is on the front portion and is below the top portion, and the elastomer filler material extends above the top perimeter of the strike plate.

14. The iron-type golf club head of claim 10, wherein a ratio of the sole wrap thickness Tsolewrap to the face maximum thickness Tfacemax is at least 0.40.

15. The iron-type golf club head of claim 10, wherein a portion of the sole wrap portion is welded to the sole portion at a location at least 4 mm rearward of a leading edge of the strike face.

16. The iron-type golf club head of claim 10, wherein the maximum topline width Wtopline is no more than 6.5 mm.

17. The iron-type golf club head of claim 10, wherein a ratio of a topline thickness Ttopline to the face maximum thickness Tfacemax is between 0.4 and 1.0.

18. The iron-type golf club head of claim 10, wherein the weight length (LW) is at least 35% of the blade length (LB).

19. The iron-type golf club head of claim 18, wherein the elastomer filler material has a filler material density of less than 0.71 g/cc.

20. The iron-type golf club head of claim 19, wherein the golf club head has a center of gravity located at a Z-up elevation above the ground plane, the maximum weight height elevation (HWT) of the weight is less than the Z-up elevation, and the rear wall, above the midplane and adjacent to the internal cavity, has a rear wall thickness Trear less than the face maximum thickness Tfacemax.

21. The iron-type golf club head of claim 20, wherein the filler material density is less than 0.49 g/cc.

22. The iron-type golf club head of claim 21, wherein the sole portion includes a back-constraining wall, the internal shelf extends from the back-constraining wall, and the back-constraining wall is parallel to an external surface of the strike face.

23. The iron-type golf club head of claim 22, wherein the sole portion includes an upper-constraining wall extending from the back-constraining wall, and a portion of the weight is between the internal shelf and the upper-constraining wall.

24. The iron-type golf club head of claim 21, wherein the above midplane maximum front-to-back cavity depth is no more than 10 mm.

25. The iron-type golf club head of claim 21, wherein the ratio of the internal cavity volume to the external club head volume is no more than 0.385.

26. The iron-type golf club head of claim 21, wherein the rear wall thickness Trear, above the midplane of the golf club head and adjacent to the internal cavity, is less than 2 mm.

27. The iron-type golf club head of claim 21, wherein the elastomer filler material has a filler has a filler material mass of 2-10 grams.

28. The iron-type golf club head of claim 21, wherein the Z-up elevation is 17.9-20 mm.

29. The iron-type golf club head of claim 21, wherein the face minimum thickness Tfacemin is less than 2 mm, and the face maximum thickness Tfacemax is less than 2.85 mm.

30. The iron-type golf club head of claim 21, wherein the golf club head has a coefficient of restitution value greater than 0.79 as measured according to the United States Golf Association (USGA) rules set forth in the Procedure for Measuring the Velocity Ratio of a Club Head for Conformance to Rule 4-1e, Appendix II Revision 2 Feb. 8, 1999.

31. The iron-type golf club head of claim 21, wherein a top perimeter of the strike plate extends to the top portion, and the top perimeter of the strike plate is welded to the top portion.

32. The iron-type golf club head of claim 21, further including an injection port extending through the toe portion to the internal cavity, and a plug seals the injection port and has a plug mass of less than 15 grams.

33. The iron-type golf club head of claim 32, wherein the injection port has a port length of at least 7 mm.

34. The iron-type golf club head of claim 32, wherein a portion of the injection port opens to the internal cavity at an elevation above a portion of the weight.

35. The iron-type golf club head of claim 1, wherein a first front-to-back depth of the internal cavity is proximate the midplane of the golf club head, a second front-to-back depth of the internal cavity is proximate the top portion, and a third front-to-back depth of the internal cavity is located in between the midplane of the golf club and the top portion, wherein the third front-to-back depth is less than the first front-to-back depth and the second front-to-back depth.

36. The iron-type golf club head of claim 35, wherein the third front-to-back depth is less than 5 mm.

37. An iron-type golf club head, comprising:

a body, made of a body material having a body material density, wherein the body comprises:

a heel portion;

a toe portion;

a sole portion, comprising an internal shelf;

a top portion;

a front portion, comprising a face opening; and a rear portion, comprising a rear wall extending from the sole portion to the top portion;

a strike plate with a face maximum thickness Tfacemax, made of a strike plate material different than the body material, welded to the body and covering the face opening and thereby creating a strike face having a geometric center;

a weight, made of a weight material having a weight density greater than the body material density, at least partially seated on the internal shelf and configured such that no portion of the weight defines an exterior surface of the golf club head, the weight does not contact the strike plate, and a center of gravity of the weight is located toeward of the geometric center of the strike face;

an internal cavity, having an internal cavity volume defined by the sole portion, the top portion, the strike face, and the rear portion;

an elastomer filler material, located within the internal cavity; and an injection port extending through a portion of the body to the internal cavity with a portion of the injection port opening to the internal cavity at an elevation above a portion of the weight, and a plug sealing the injection port and having a plug mass of less than 15 grams;

wherein:

the golf club head has an external club head volume ranging between 40 cc to 55 cc, a ratio of the internal cavity volume to an external club head volume is at least 0.22, and the internal cavity volume is no more than 20 cc;

the golf club head has a maximum topline width Wtopline of 5.0-9.0 mm;

the golf club head has a blade length (LB) of 73-83 mm;

the weight has a weight height (HW), a weight depth (DW), a weight length (LW) that is greater than the weight depth (DW), and the weight length (LW) is no more than 65% of the blade length (LB);

the weight density is at least 12 g/cc and the weight has a mass of at least 10 grams;

the internal cavity has a topline-adjacent internal cavity depth proximate the top portion that is no more than 6 mm;

a midplane is located halfway between a maximum toe height and a ground plane when the golf club head is in an address position, the internal cavity extends below the midplane and above the midplane, and above the midplane the internal cavity comprises:

an above midplane maximum front-to-back cavity depth that is no more than 12 mm; and an above midplane minimum front-to-back cavity depth that is less than the above midplane maximum front-to-back cavity depth;

the elastomer filler material extends above the midplane, and below the midplane;

an offset, in a front-to-rear direction, between a forwardmost portion of a hosel and a leading edge of the strike face is less than 4.0 mm;

the strike plate further comprises a sole wrap portion that defines a part of the sole portion and forms a portion of the internal cavity, a portion of the sole wrap portion is welded to the sole portion, the elastomer filler material contacts the sole wrap portion, and a sole wrap thickness Tsolewrap of the sole wrap portion is no more than 3.3 mm; and the plug is located below the midplane.

38. The iron-type golf club head of claim 37, wherein the above midplane maximum front-to-back cavity depth is no more than 12 mm, and the ratio of the internal cavity volume to the external club head volume is at least 0.22.

39. The iron-type golf club head of claim 37, wherein a first front-to-back depth of the internal cavity is proximate the midplane of the golf club head, a second front-to-back depth of the internal cavity is proximate the top portion, and a third front-to-back depth of the internal cavity is located in between the midplane of the golf club and the top portion, wherein the third front-to-back depth is less than the first front-to-back depth and the second front-to-back depth.

40. The iron-type golf club head of claim 39, wherein the third front-to-back depth is less than 5 mm.

41. The iron-type golf club head of claim 37, wherein the injection port extends through the toe portion to the internal cavity.

42. The iron-type golf club head of claim 41, wherein the injection port has a port length of at least 7 mm.

43. The iron-type golf club head of claim 37, wherein the strike plate has a face minimum thickness Tfacemin of 1.1-2.7 mm, and the face minimum thickness Tfacemin is less than the face maximum thickness Tfacemax.

44. The iron-type golf club head of claim 37, wherein a portion of the weight is at least 20 mm toeward of the geometric center of the strike face.

45. The iron-type golf club head of claim 44, wherein a maximum weight height elevation (HWT) of the weight is less than a geometric center height (HGC) of the geometric center of the strike face.

46. The iron-type golf club head of claim 44, wherein a portion of a peripheral weld along a top perimeter of the strike plate is on the front portion and is below the top portion, and the elastomer filler material extends above the top perimeter of the strike plate.

47. The iron-type golf club head of claim 44, wherein the weight length (LW) is at least 35% of the blade length (LB).

48. The iron-type golf club head of claim 44, wherein the elastomer filler material has a filler material density of less than 0.71 g/cc.

49. The iron-type golf club head of claim 48, wherein the golf club head has a center of gravity located at a Z-up elevation above the ground plane, the maximum weight height elevation (HWT) of the weight is less than the Z-up elevation, and a portion of the rear wall, above the midplane and adjacent to the internal cavity, has a rear wall thickness Trear less than the face maximum thickness Tfacemax.

50. The iron-type golf club head of claim 48, wherein the filler material density is less than 0.49 g/cc, and a portion of the rear wall thickness Trear, above the midplane of the golf club head and adjacent to the internal cavity, is less than 2 mm.

51. The iron-type golf club head of claim 50, wherein the sole portion includes a back-constraining wall, the internal shelf extends from the back-constraining wall, and the back-constraining wall is parallel to an external surface of the strike face.

52. The iron-type golf club head of claim 51, wherein the sole portion includes an upper-constraining wall extending from the back-constraining wall, and a portion of the weight is between the internal shelf and the upper-constraining wall.

53. The iron-type golf club head of claim 44, wherein the ratio of the internal cavity volume to the external club head volume is no more than 0.385.

54. The iron-type golf club head of claim 53, wherein a portion of the rear wall thickness Trear, above the midplane of the golf club head and adjacent to the internal cavity, is less than 2 mm.

55. The iron-type golf club head of claim 54, wherein the face minimum thickness Tfacemin is less than 2 mm, and the face maximum thickness Tfacemax is less than 2.85 mm.

56. The iron-type golf club head of claim 44, wherein the golf club head has a coefficient of restitution value greater than 0.79 as measured according to the United States Golf Association (USGA) rules set forth in the Procedure for Measuring the Velocity Ratio of a Club Head for Conformance to Rule 4-1e, Appendix II Revision 2 Feb. 8, 1999.

57. The iron-type golf club head of claim 44, wherein a top perimeter of the strike plate extends to the top portion, and the top perimeter of the strike plate is welded to the top portion.

58. The iron-type golf club head of claim 37, wherein the topline-adjacent internal cavity depth is no more than 4.5 mm.

59. The iron-type golf club head of claim 37, wherein a topline thickness Ttopline of the top portion is less than the face maximum thickness Tfacemax.

60. The iron-type golf club head of claim 37, wherein a ratio of the sole wrap thickness Tsolewrap to the face maximum thickness Tfacemax is at least 0.40.

61. The iron-type golf club head of claim 60, wherein a portion of the sole wrap portion is welded to the sole portion at a location at least 4 mm rearward of a leading edge of the strike face.

62. The iron-type golf club head of claim 61, wherein a ratio of a topline thickness Ttopline to the face maximum thickness Tfacemax is between 0.4 and 1.0.

63. An iron-type golf club head, comprising:

a body, made of a body material having a body material density, wherein the body comprises:
- a heel portion;
- a toe portion;
- a sole portion, comprising an internal shelf;
- a top portion;
- a front portion, comprising a face opening; and
- a rear portion, comprising a rear wall extending from the sole portion to the top portion;

a strike plate with a face maximum thickness Tfacemax and a face minimum thickness Tfacemin of 1.1-2.7 mm and less than the face maximum thickness Tfacemax, the strike plate made of a strike plate material different than the body material, welded to the body and covering the face opening and thereby creating a strike face having a geometric center;

a weight, made of a weight material having a weight density greater than the body material density, at least partially seated on the internal shelf and configured such that no portion of the weight defines an exterior surface of the golf club head, and the weight does not contact the strike plate, a portion of the weight is at least 20 mm toeward of the geometric center of the strike face, and a maximum weight height elevation (HWT) of the weight is less than a geometric center height (HGC) of the geometric center of the strike face;

an internal cavity, having an internal cavity volume defined by the sole portion, the top portion, the strike face, and the rear portion;

an elastomer filler material, located within the internal cavity; and an injection port extending through a portion of the body to the internal cavity with a portion of the injection port opening to the internal cavity at an elevation above a portion of the weight, and a plug sealing the injection port and having a plug mass of less than 15 grams;

wherein:

the golf club head has an external club head volume ranging between 40 cc to 55 cc, a ratio of the internal cavity volume to an external club head volume is at least 0.14, and the internal cavity volume is no more than 20 cc;

the golf club head has a maximum topline width Wtopline of 5.0-9.0 mm;

the golf club head has a blade length (LB) of 73-83 mm;

the weight has a weight height (HW), a weight depth (DW), a weight length (LW) that is greater than the weight depth (DW), and the weight length (LW) is no more than 65% of the blade length (LB);

the weight density is at least 12 g/cc and the weight has a mass of at least 10 grams;

the internal cavity has a topline-adjacent internal cavity depth proximate the top portion that is no more than 6 mm;

a midplane is located halfway between a maximum toe height and a ground plane when the golf club head is in an address position, the internal cavity extends below the midplane and above the midplane, and above the midplane the internal cavity comprises:
- an above midplane maximum front-to-back cavity depth that is no more than 13 mm; and
- an above midplane minimum front-to-back cavity depth that is less than the above midplane maximum front-to-back cavity depth;

the elastomer filler material extends above the midplane, and below the midplane, and below a portion of the weight; and an offset, in a front-to-rear direction, between a forwardmost portion of a hosel and a leading edge of the strike face is less than 4.0 mm.

64. The iron-type golf club head of claim 63, wherein the above midplane maximum front-to-back cavity depth is no more than 12 mm, and the ratio of the internal cavity volume to the external club head volume is at least 0.22.

65. The iron-type golf club head of claim 63, wherein a first front-to-back depth of the internal cavity is proximate the midplane of the golf club head, a second front-to-back depth of the internal cavity is proximate the top portion, and a third front-to-back depth of the internal cavity is located in between the midplane of the golf club and the top portion, wherein the third front-to-back depth is less than the first front-to-back depth and the second front-to-back depth.

66. The iron-type golf club head of claim 65, wherein the third front-to-back depth is less than 5 mm.

67. The iron-type golf club head of claim 63, wherein the injection port extends through the toe portion to the internal cavity.

68. The iron-type golf club head of claim 67, wherein the injection port has a port length of at least 7 mm.

69. The iron-type golf club head of claim 67, wherein a portion of the injection port opens to the internal cavity at an elevation above a portion of the weight.

70. The iron-type golf club head of claim 63, wherein a center of gravity of the weight is located toeward of the geometric center of the strike face.

71. The iron-type golf club head of claim 63, wherein the topline-adjacent internal cavity depth is no more than 4.5 mm.

72. The iron-type golf club head of claim 71, wherein a topline thickness Ttopline of a portion of the top portion is less than the face maximum thickness Tfacemax.

73. The iron-type golf club head of claim 63, wherein a portion of a peripheral weld along a top perimeter of the strike plate is on the front portion and is below the top portion, and the elastomer filler material extends above the top perimeter of the strike plate.

74. The iron-type golf club head of claim 63, wherein the strike plate further comprises a sole wrap portion that defines a part of the sole portion and forms a portion of the internal cavity, and the elastomer filler material contacts the sole wrap portion.

75. The iron-type golf club head of claim 74, wherein a portion of the sole wrap portion has (a) a sole wrap thickness Tsolewrap of no more than 3.3 mm, and (b) a ratio of the sole wrap thickness Tsolewrap to the face maximum thickness Tfacemax of at least 0.40.

76. The iron-type golf club head of claim 74, wherein a portion of the sole wrap portion is welded to the sole portion at a location at least 4 mm rearward of a leading edge of the strike face.

77. The iron-type golf club head of claim 63, wherein a ratio of a topline thickness Ttopline to the face maximum thickness Tfacemax is between 0.4 and 1.0.

78. The iron-type golf club head of claim 63, wherein the weight length (LW) is at least 35% of the blade length (LB).

79. The iron-type golf club head of claim 63, wherein the elastomer filler material has a filler material density of less than 0.71 g/cc.

80. The iron-type golf club head of claim 79, wherein the golf club head has a center of gravity located at a Z-up elevation above the ground plane, and the maximum weight height elevation (HWT) of the weight is less than the Z-up elevation.

81. The iron-type golf club head of claim 79, wherein the filler material density is less than 0.49 g/cc.

82. The iron-type golf club head of claim 63, wherein the sole portion includes a back-constraining wall, the internal shelf extends from the back-constraining wall.

83. The iron-type golf club head of claim 82, wherein the sole portion includes an upper-constraining wall extending from the back-constraining wall, and a portion of the weight is between the internal shelf and the upper-constraining wall.

84. The iron-type golf club head of claim 63, wherein the ratio of the internal cavity volume to the external club head volume is no more than 0.385.

85. The iron-type golf club head of claim 84, wherein a portion of the rear wall thickness Trear, above the midplane of the golf club head and adjacent to the internal cavity, is less than 2 mm.

86. The iron-type golf club head of claim 84, wherein the face minimum thickness Tfacemin is less than 2 mm, and the face maximum thickness Tfacemax is less than 2.85 mm.

87. The iron-type golf club head of claim 84, wherein the golf club head has a coefficient of restitution value greater than 0.79 as measured according to the United States Golf Association (USGA) rules set forth in the Procedure for Measuring the Velocity Ratio of a Club Head for Conformance to Rule 4-1e, Appendix II Revision 2 Feb. 8, 1999.

88. The iron-type golf club head of claim 84, wherein a top perimeter of the strike plate extends to the top portion, and the top perimeter of the strike plate is welded to the top portion.

* * * * *